US009163790B2

(12) United States Patent
Ogata et al.

(10) Patent No.: US 9,163,790 B2
(45) Date of Patent: Oct. 20, 2015

(54) LED ILLUMINATION DEVICE AND LED LIGHT-EMISSION MODULE

(71) Applicant: PANASONIC CORPORATION, Osaka (JP)

(72) Inventors: Toshifumi Ogata, Osaka (JP); Atsuyoshi Ishimori, Osaka (JP); Masumi Abe, Osaka (JP); Hiroshi Yamaguchi, Osaka (JP); Yasufumi Wada, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 168 days.

(21) Appl. No.: 14/133,785

(22) Filed: Dec. 19, 2013

(65) Prior Publication Data

US 2014/0177217 A1 Jun. 26, 2014

(30) Foreign Application Priority Data

Dec. 20, 2012 (JP) ..... 2012-278541

(51) Int. Cl.
*F21K 99/00* (2010.01)
*H05B 33/08* (2006.01)
(Continued)

(52) U.S. Cl.
CPC ..... *F21K 9/56* (2013.01); *H05B 33/086* (2013.01); *F21S 8/026* (2013.01); *F21Y 2101/02* (2013.01); *F21Y 2105/003* (2013.01); *F21Y 2113/005* (2013.01)

(58) Field of Classification Search
CPC ..... F21K 9/56; H05B 33/086
USPC ..... 362/231, 84, 249.02, 311.02
See application file for complete search history.

(56) References Cited

U.S. PATENT DOCUMENTS 7,745,985 B2 6/2010 Tanimoto et al.
8,013,515 B2 9/2011 Tanimoto et al.
(Continued)

FOREIGN PATENT DOCUMENTS

CN 102041002 A 5/2011
JP 2008-235500 10/2008
(Continued)

OTHER PUBLICATIONS

Extended European Search Report in EP Application No. 13198328.0, dated Jul. 9, 2014.
(Continued)

*Primary Examiner* — David V Bruce
(74) *Attorney, Agent, or Firm* — Greenblum & Bernstein, P.L.C.

(57) ABSTRACT

An illumination device and a light-emission module suppressing a change in color temperature when light emitted from a light-emission unit passes through an optical member. The illumination device has a lighting apparatus that includes: a first light-emission part emitting light of a daylight color temperature; a second light-emission part emitting light of an incandescent lamp color temperature; and the optical member, which is disposed on an optical path of the light emitted from the light-emission parts. A correlated color temperature of the light emitted from the second light-emission part is set to 2238 K. Due to this, in a spectrum of the light emitted from the second light-emission part, a maximum intensity within a wavelength range from 400 nm to 500 nm is no greater than one-tenth of a maximum intensity within a wavelength range from 300 nm to 800 nm.

12 Claims, 13 Drawing Sheets

(51) Int. Cl.

| | |
|---|---|
| *F21S 8/02* | (2006.01) |
| *F21Y 101/02* | (2006.01) |
| *F21Y 105/00* | (2006.01) |
| *F21Y 113/00* | (2006.01) |

(56) References Cited

U.S. PATENT DOCUMENTS

| | | | |
|---|---|---|---|
| 8,039,850 | B2 | 10/2011 | Lee et al. |
| 8,773,012 | B2 | 7/2014 | Ryu et al. |
| 2007/0023762 | A1 | 2/2007 | Gumins et al. |
| 2009/0114929 | A1 | 5/2009 | Lee et al. |
| 2009/0140633 | A1 | 6/2009 | Tanimoto et al. |
| 2010/0134043 | A1 | 6/2010 | Kadotani et al. |
| 2010/0219745 | A1 | 9/2010 | Tanimoto et al. |
| 2011/0096560 | A1 | 4/2011 | Ryu et al. |
| 2014/0009061 | A1* | 1/2014 | Itoga et al. ..... 313/503 |
| 2014/0133146 | A1 | 5/2014 | Ryu et al. |
| 2015/0108521 | A1* | 4/2015 | Hattori et al. ..... 257/98 |

FOREIGN PATENT DOCUMENTS

| | | |
|---|---|---|
| JP | 2009-512178 | 3/2009 |
| JP | 2009-117825 | 5/2009 |
| KR | 10-2011-0122298 A | 11/2011 |

OTHER PUBLICATIONS

Office Action in Chinese CN 201310712608.2, with partial English language translation, dated May 5, 2015.

* cited by examiner

LED ILLUMINATION DEVICE AND LED LIGHT-EMISSION MODULE

CROSS-REFERENCE TO RELATED APPLICATIONS

This application is based on application No. 2012-278541 filed in Japan, the contents of which are hereby incorporated by reference.

TECHNICAL FIELD

The present invention relates to illumination devices and light-emission modules using LEDs as light sources, and in particular, to a technology for suppressing a difference between a desired color and an actual color of illumination light from an illumination device, particularly when the color of the illumination light is adjusted by controlling light emitted from a plurality of light sources.

BACKGROUND ART

Various types of LED illumination devices using light-emitting diodes (LEDs) as light sources are being developed. Examples of such LED illumination devices include down-light-type LED illumination devices and desk stand-type LED illumination devices (refer to Patent Literature 1, for example).

For example, a typical LED illumination device includes: a light-emission module including a plurality of light-emission parts each of a different color temperature; an optical member that is a lens, a reflection member, etc., disposed on an optical path of light emitted from the light-emission parts; and a lighting circuit for lighting light-emission elements included in the light-emission parts. Each of the light-emission parts includes: a light-emission element that is an LED. In addition, each of the light-emission parts includes a wavelength conversion member that is disposed so as to cover the light-emission element. The wavelength conversion member includes fluorescent material, and converts some light emitted from the light-emission element. Light emitted from each of the light-emission parts is provided with a desired color temperature by mixing the light emitted from the light-emission element and the wavelength-converted light output from the wavelength conversion member. For example, a typical LED illumination device whose light color is adjustable includes a light-emission part of an incandescent lamp color, which corresponds to a color temperature of around 2500 Kelvin (K) on the black body curve, and a light-emission part of a daylight color, which corresponds to a color temperature of around 8000 K on the black body curve. Note that in the present disclosure, the unit K (Kelvin) indicates a correlated color temperature. Further, in the context of the present disclosure, the term "correlated color temperature" is used for both correlated color temperatures on the black body curve and correlated color temperatures that are not exactly on the black body curve.

When driving the LED illumination device and adjusting the color temperature of the illumination light from the LED illumination device to a desired color temperature, the light-emission part of the incandescent lamp color and the light-emission part of the daylight color are caused to light simultaneously, and the color of the light emitted from the light-emission part of the incandescent lamp color and the color of the light emitted from the light-emission part of the daylight color are mixed. By mixing the light colors of the different light-emission parts, the color temperature of the illumination light from the LED illumination device is adjustable within a wide range of color temperatures from approximately 2500 K to approximately 8000 K.

CITATION LIST

Patent Literature

[Patent Literature 1]
Japanese Patent Application Publication No. 2009-117825
[Patent Literature 2]
Japanese Patent Application Publication No. 2008-235500
[Patent Literature 3]
Japanese Translation of PCT International Application Publication No. 2009-512178

SUMMARY OF INVENTION

Technical Problem

FIG. 13 is a cross-sectional view schematically illustrating an LED illumination device including: a light-emission module having a substrate and light-emission elements of different color temperatures mounted on the substrate; and an optical member (a lens). Specifically, FIG. 13 illustrates a state where light emitted from a light-emission element of a high color temperature and light emitted from a light-emission element of a low color temperature are passing through the optical member. As illustrated in FIG. 13, an optical member in general absorbs visible light within a certain wavelength range. For example, an optical member used in an LED illumination device may absorb more spectral components of visible light within a wavelength range from 400 nm to 470 nm, which corresponds to the wavelength range of blue light, compared to within other wavelengths ranges. As such, even when light emitted from a given light-emission part has a desired color temperature at the point of emission, the color temperature of the light may change from the desired color temperature to a different color temperature when transmitting through the optical member. This results in the color temperature of the illumination light emitted from the LED illumination device not being adjusted to the correct color temperature.

In view of this, the present invention provides an illumination device and a light-emission module suppressing a change in the color temperature of light emitted from a light-emission part, occurring when the light emitted from the light-emission part passes through an optical member.

Solution to the Problems

One aspect of the present invention is an illumination device comprising: a first light-emission part that emits light of a first correlated color temperature; a second light-emission part that emits light of a second correlated color temperature, the second correlated color temperature being lower than the first correlated color temperature; an optical member that is disposed at least on an optical path of the light emitted from the second light-emission part; and a color adjustment unit that adjusts a color of light that is a mixture of the light emitted from the first light-emission part and the light emitted from the second light-emission part by controlling an intensity of the light emitted from the first light-emission part and an intensity of the light emitted from the second light-emission part. In the illumination device pertaining to one aspect of the present invention, in a spectrum of the light emitted from the second light-emission part, a maximum intensity within a wavelength range from 400 nm to 500 nm is no greater than one-tenth of a maximum intensity within a wavelength range from 300 nm to 800 nm.

In the illumination device pertaining to one aspect of the present invention, the second correlated color temperature may be lower than 2600 Kelvin (K).

In the illumination device pertaining to one aspect of the present invention, at least one of the first light-emission part and the second light-emission part may include one or more light-emission elements and a wavelength conversion member that converts a wavelength of light emitted from the one or more light-emission elements, wherein a spectrum of the light emitted from the one or more light-emission elements has a main peak within a wavelength range from 430 nm to 470 nm, and the wavelength conversion member is made of transparent material and fluorescent material dispersed in the transparent material, the fluorescent material being a combination of red fluorescent material, and one of green fluorescent material and yellow fluorescent material.

In the illumination device pertaining to one aspect of the present invention, the optical member may include an optical element that absorbs light within the wavelength range from 400 nm to 500 nm.

In the illumination device pertaining to one aspect of the present invention, the first correlated color temperature may be higher than or equal to 6000 Kelvin (K).

The illumination device pertaining to one aspect of the present invention may further comprise: a mounting substrate on which the first light-emission part and the second light-emission part are mounted.

The illumination device pertaining to one aspect of the present invention may further comprise: a first mounting substrate on which the first light-emission part is mounted; and a second mounting substrate on which the second light-emission part is mounted.

Another aspect of the present invention is a light-emission module comprising: a substrate; and a light-emission unit disposed on the substrate, the light-emission unit including: a first light-emission part that emits light of a first correlated color temperature; and a second light-emission part that emits light of a second correlated color temperature, the second correlated color temperature being lower than the first correlated color temperature. In the light-emission module pertaining to another aspect of the present invention, in a spectrum of the light emitted from the second light-emission part, a maximum intensity within a wavelength range from 400 nm to 500 nm is no greater than one-tenth of a maximum intensity within a wavelength range from 300 nm to 800 nm.

In the lighting emission module pertaining to another aspect of the present invention, at least one of the first light-emission part and the second light-emission part may include one or more light-emission elements and a wavelength conversion member that converts a wavelength of light emitted from the one or more light-emission elements, wherein a spectrum of the light emitted from the one or more light-emission elements has a main peak within a wavelength range from 430 nm to 470 nm, the wavelength conversion member is made of transparent material and fluorescent material dispersed in the transparent material, the fluorescent material being a combination of red fluorescent material, and one of green fluorescent material and yellow fluorescent material, and the wavelength conversion member is disposed so as to cover the one or more light-emission units.

In the light-emission module pertaining to another aspect of the present invention, the second correlated color temperature may be lower than 2600 Kelvin (K).

In the light-emission module pertaining to another aspect of the present invention, at least one of the first light-emission part and the second light-emission part may include one or more light-emission elements and a wavelength conversion member that converts a wavelength of light emitted from the one or more light-emission elements, wherein the wavelength conversion member is made of transparent resin and fluorescent material dispersed in the transparent resin.

Advantageous Effects of the Invention

According to the illumination device pertaining to one aspect of the present invention, in the spectrum of the light emitted from the second light-emission part, the maximum intensity within the wavelength range from 400 nm to 500 nm is no greater than one-tenth of the maximum intensity within the wavelength range from 300 nm to 800 nm. By reducing the spectral intensity of the light emitted from the second light-emission part within the wavelength range from 400 nm to 500 nm, even when the optical member has characteristics of absorbing spectral components of visible light within a short wavelength range (the wavelength range of blue light), the amount of light absorbed by the optical member, within the wavelength range from 400 nm to 500 nm, is reduced. As such, the change in the color temperature of light emitted from the second light-emission part, which corresponds to a low color temperature, occurring at the optical member is suppressed. Accordingly, the illumination device pertaining to one aspect of the present invention is expected to suppress the difference between a desired color temperature and an actual color temperature of illumination light when the color temperature of the illumination light is adjusted by mixing light emitted from the light emitted from the first light-emission part and the light emitted from the second light-emission part.

Figure 6:
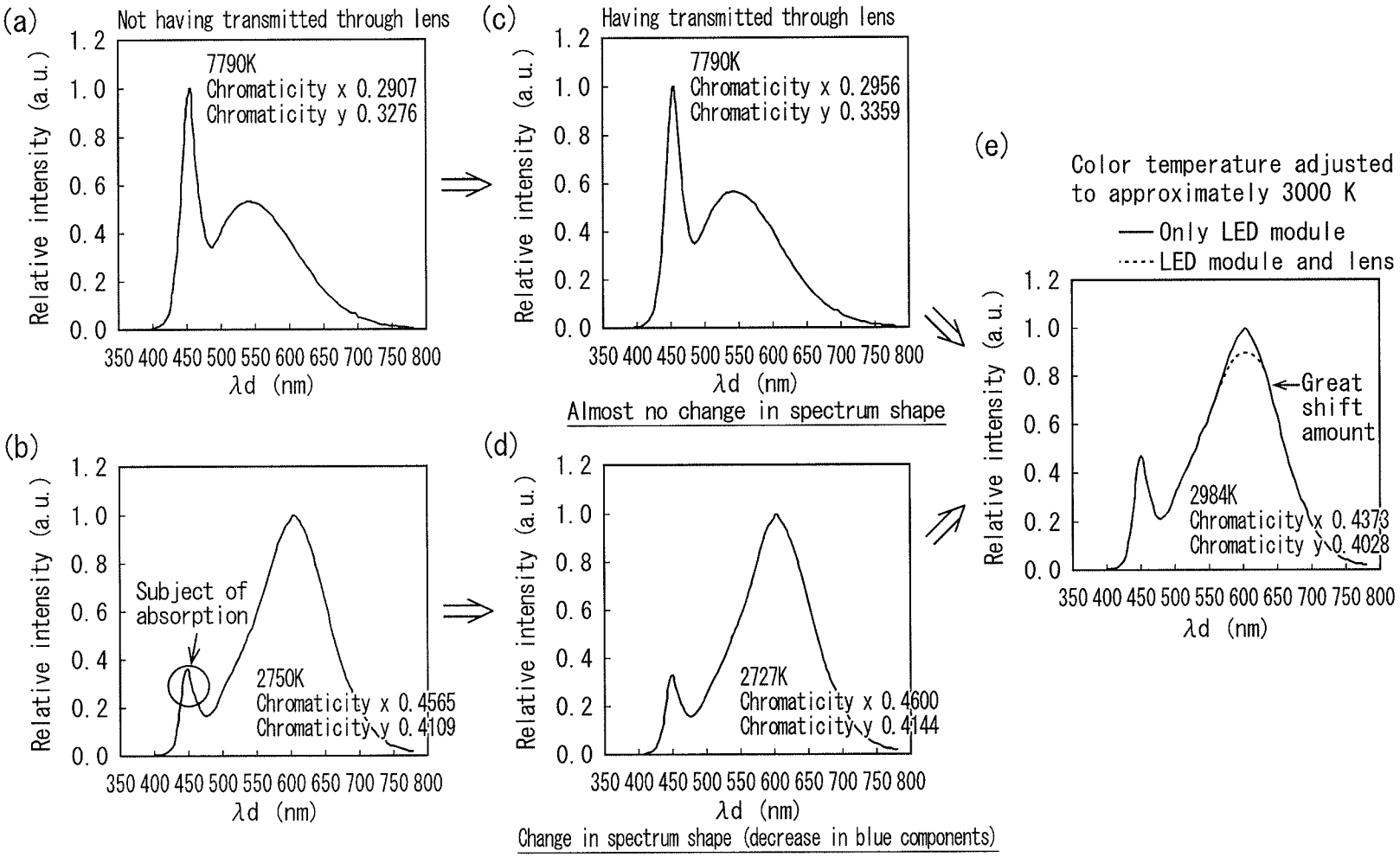

Portion (a) of FIG. 6 illustrates a spectrum of light emitted from a first light-emission part (corresponding to a color temperature of 7790 K) in a conventional LED illumination device (comparative example device), not having passed through an optical member of the comparative example device; portion (b) of FIG. 6 illustrates a spectrum of light emitted from a second light-emission part (corresponding to a color temperature of 2750 K) in the comparative example device, not having passed through the optical member; portion (c) of FIG. 6 illustrates a spectrum of the light emitted from the first light-emission part, having passed through the optical member; portion (d) of FIG. 6 illustrates a spectrum of the light emitted from the second light-emission part, having passed through the optical member; and portion (e) of FIG. 6 illustrates a spectrum of illumination light from the comparative example device having a color temperature thereof adjusted to approximately 3000 K (in specific, 2984 K) by mixing the light emitted from the first and second light-emission parts, having passed through the optical member.

Figure 7:
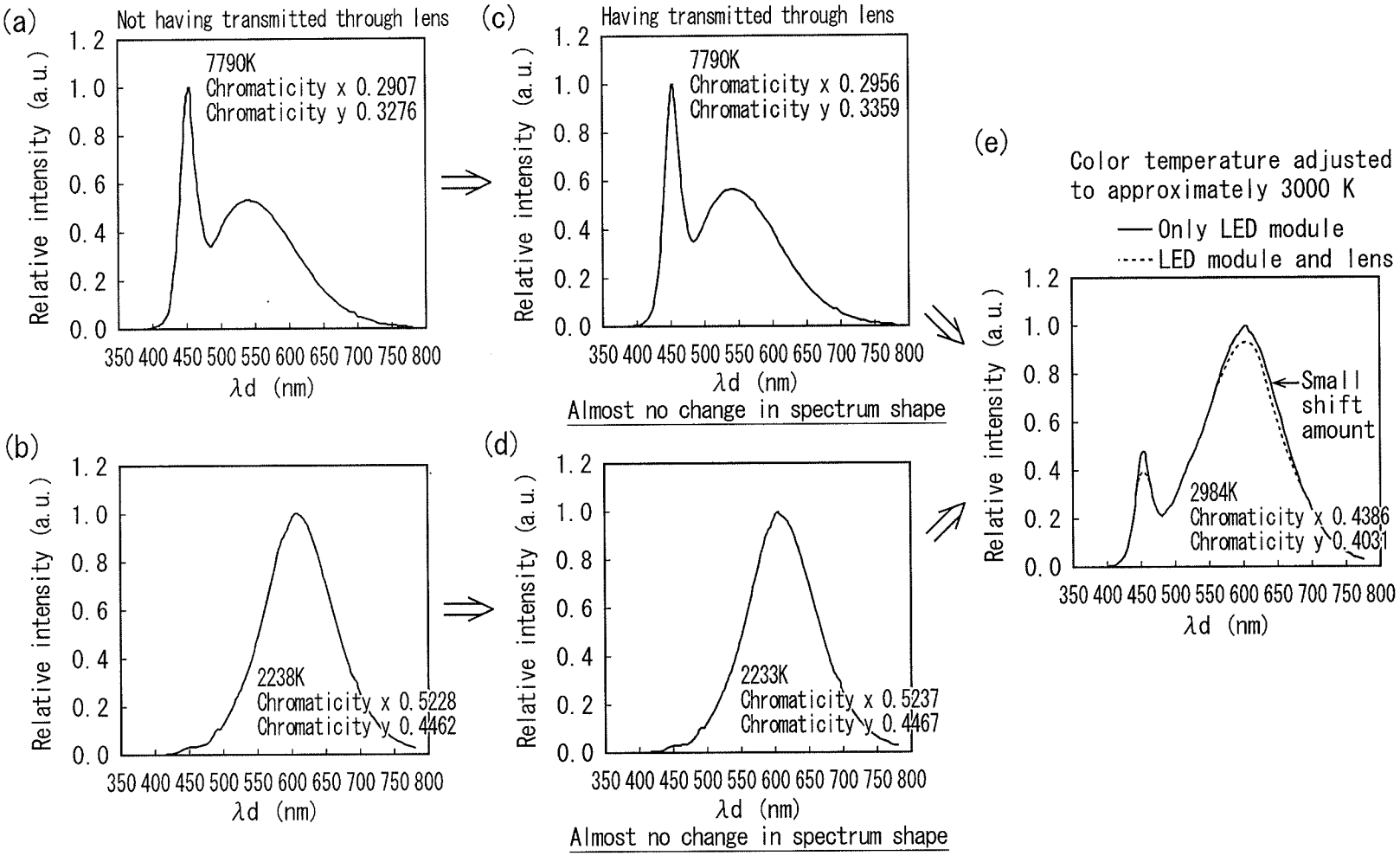

Portion (a) of FIG. 7 illustrates a spectrum of light emitted from a first light-emission part 12*a* (corresponding to a color temperature of 7790 K) in the device 1 pertaining to embodiment 1 (implementation example device), not having passed through an optical member 50 of the device 1; portion (b) of FIG. 7 illustrates a spectrum of light emitted from a second light-emission part 12*b* (corresponding to a color temperature of 2750 K) in the device 1, not having passed through the optical member 50; portion (c) of FIG. 7 illustrates a spectrum of the light emitted from the first light-emission part 12*a*, having passed through the optical member 50; portion (d) of FIG. 7 illustrates a spectrum of the light emitted from the second light-emission part 12*b*, having passed through the optical member 50; and portion (e) of FIG. 7 illustrates a spectrum of illumination light from the device 1 having a color temperature thereof adjusted to approximately 3000 K (in specific, 2984 K) by mixing the light emitted from the light-emission parts 12*a* and 12*b*, having passed through the optical member 50.

Figure 8:
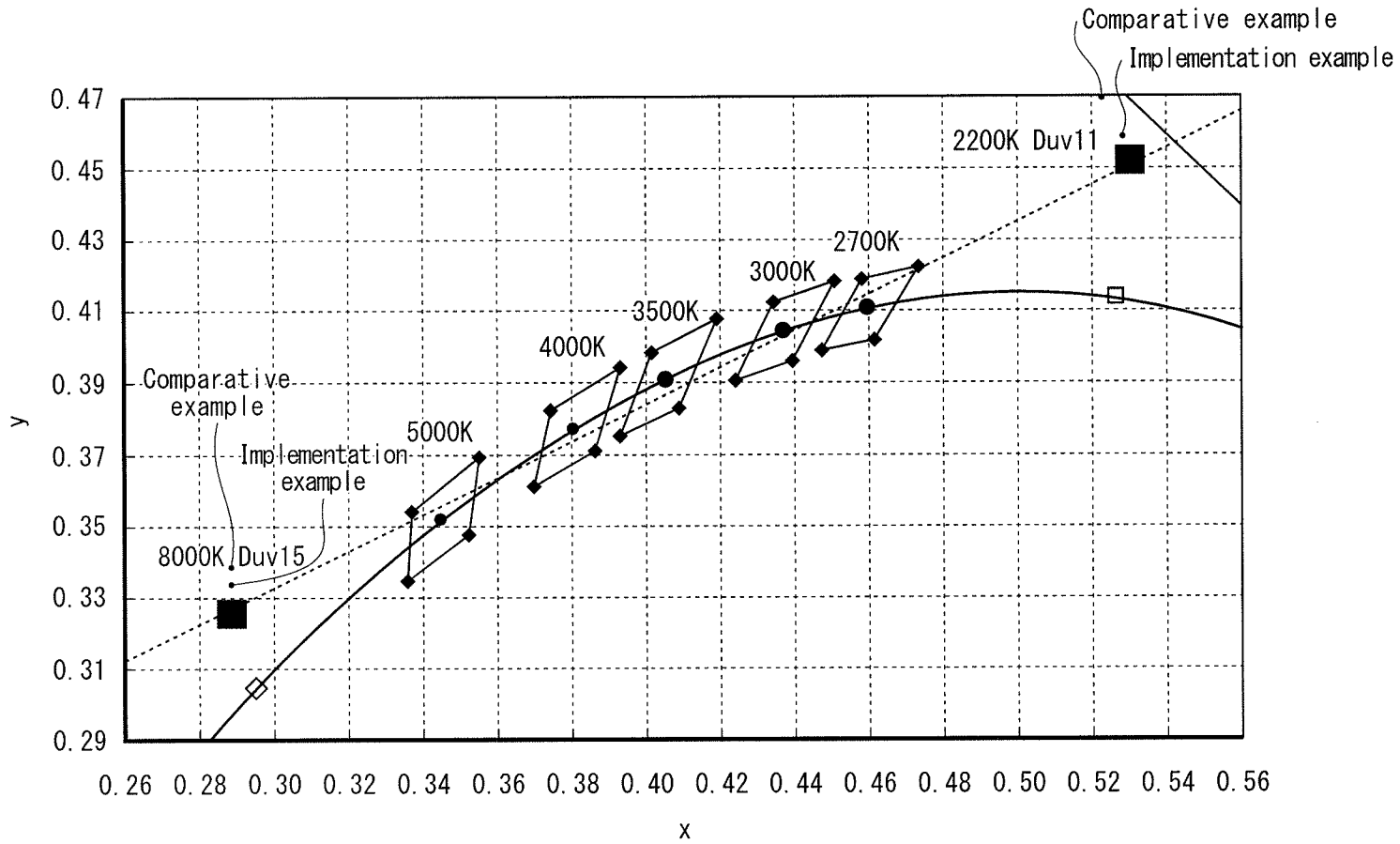

FIG. 8 is a partial chromaticity diagram plotting color temperatures of the implementation example and the comparative example.

Figure 9:
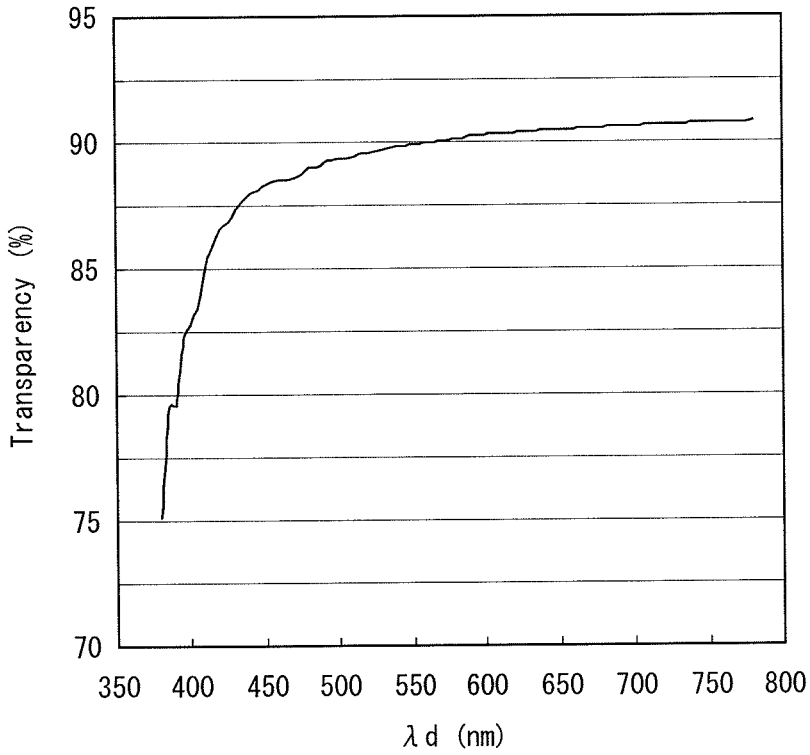

FIG. 9 is a graph illustrating transmittance (spectral characteristics) of a typical lens member with respect to wavelengths of a visible spectrum.

Figure 10:
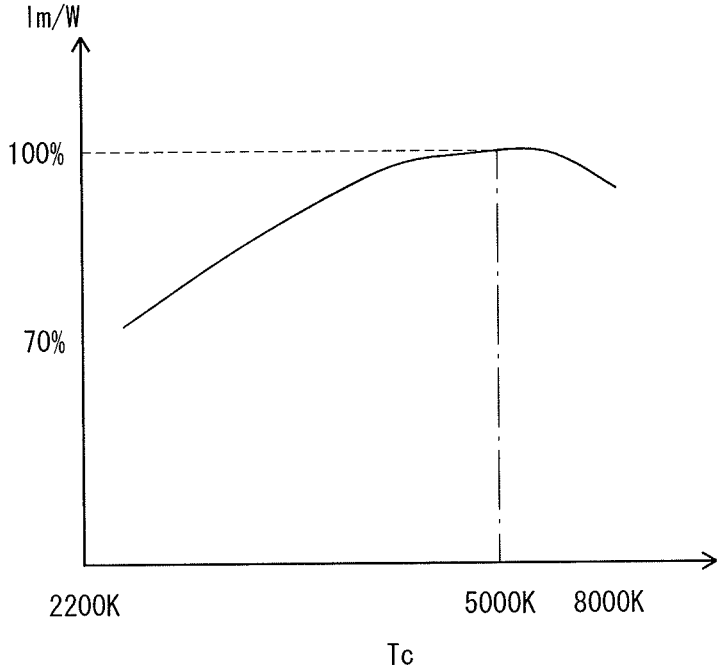

FIG. 10 is a graph illustrating a relation between a color temperature and light-emission efficiency of a light-emission part.

Figure 11:
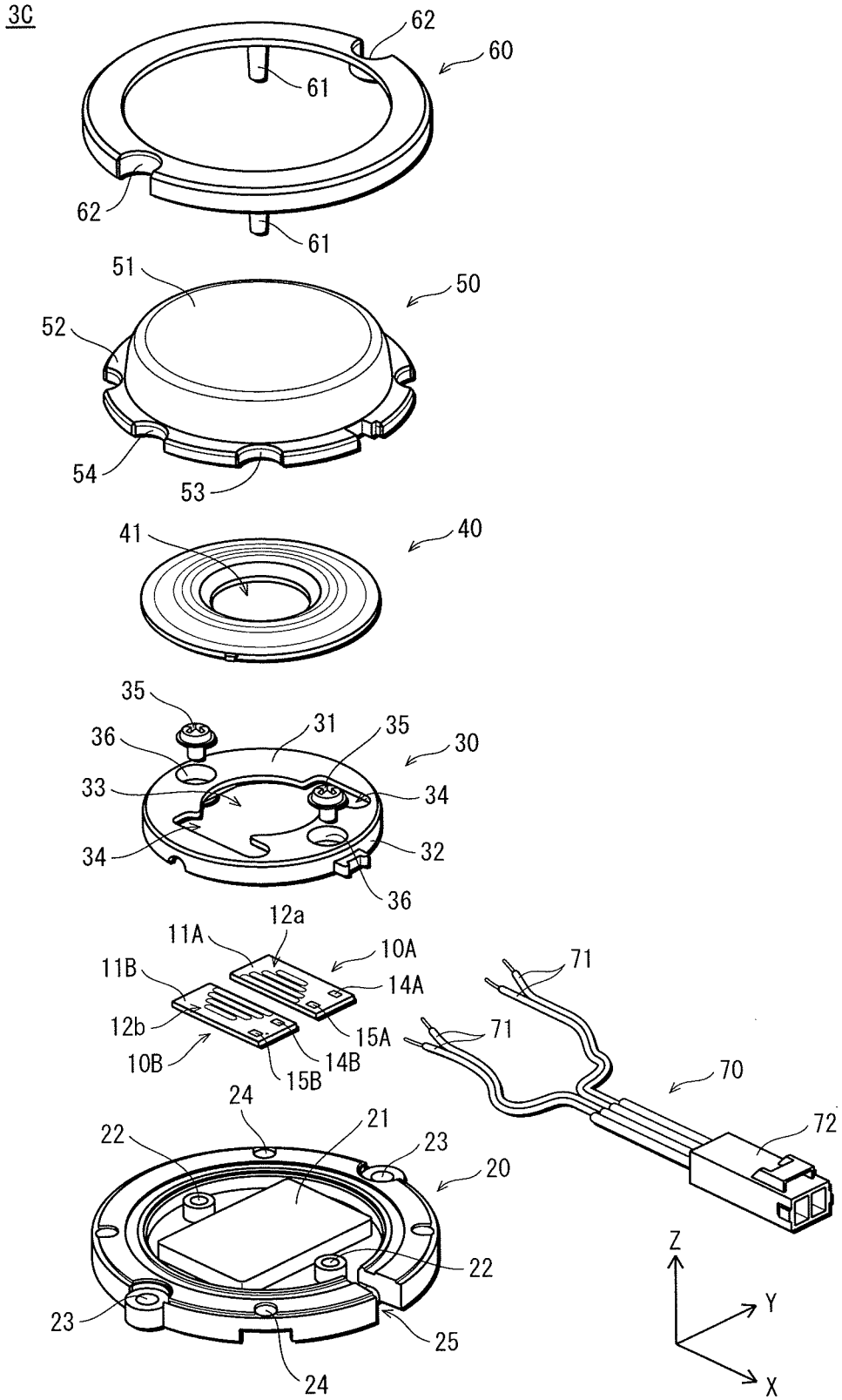

FIG. 11 is an exploded perspective view illustrating an internal structure of a lamp unit 3C pertaining to embodiment 2.

Figure 12:
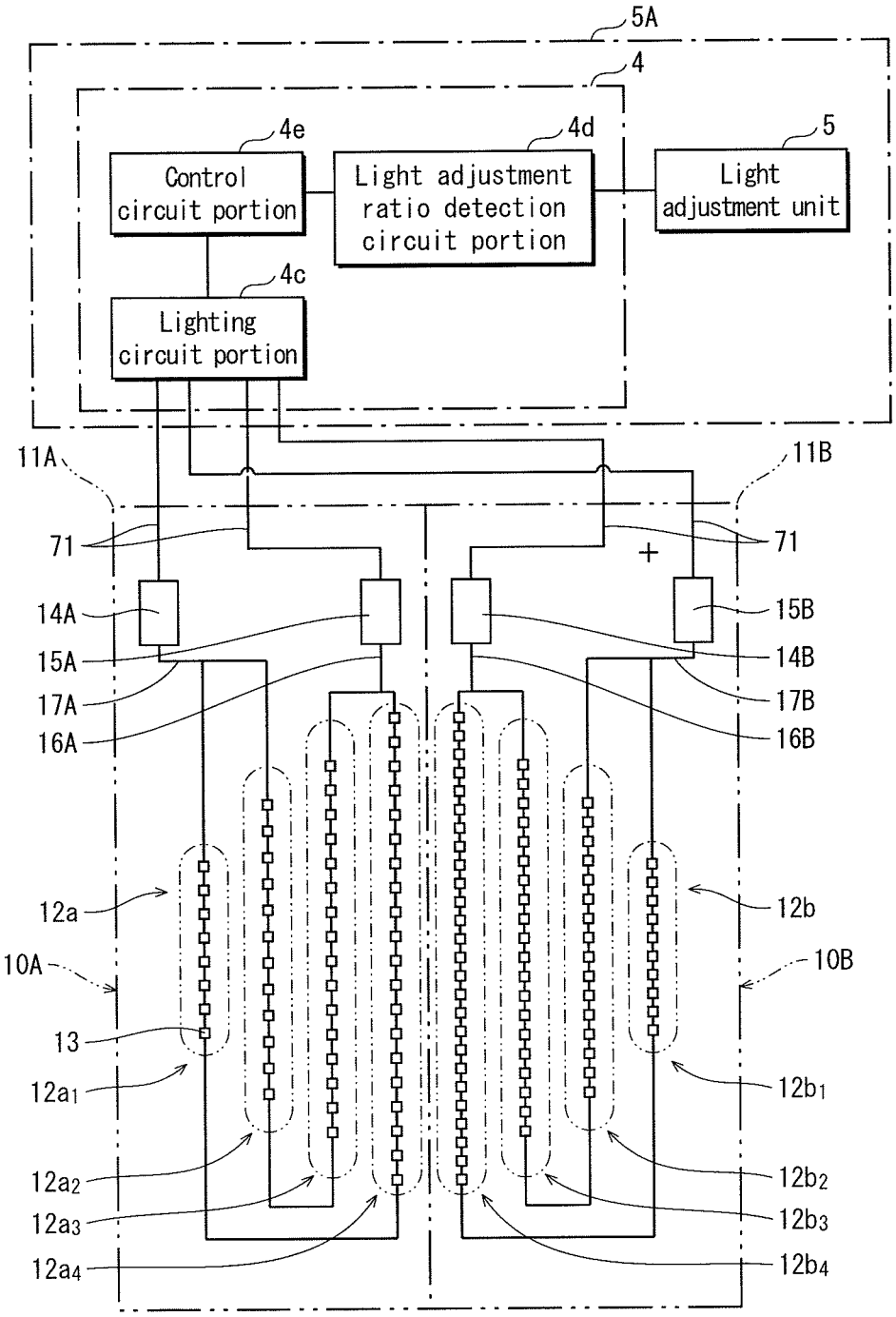

FIG. 12 is a wiring diagram illustrating a connection between light-emission modules 10A and 10B, the circuit unit 4, and the light adjustment unit 5.

Figure 13:
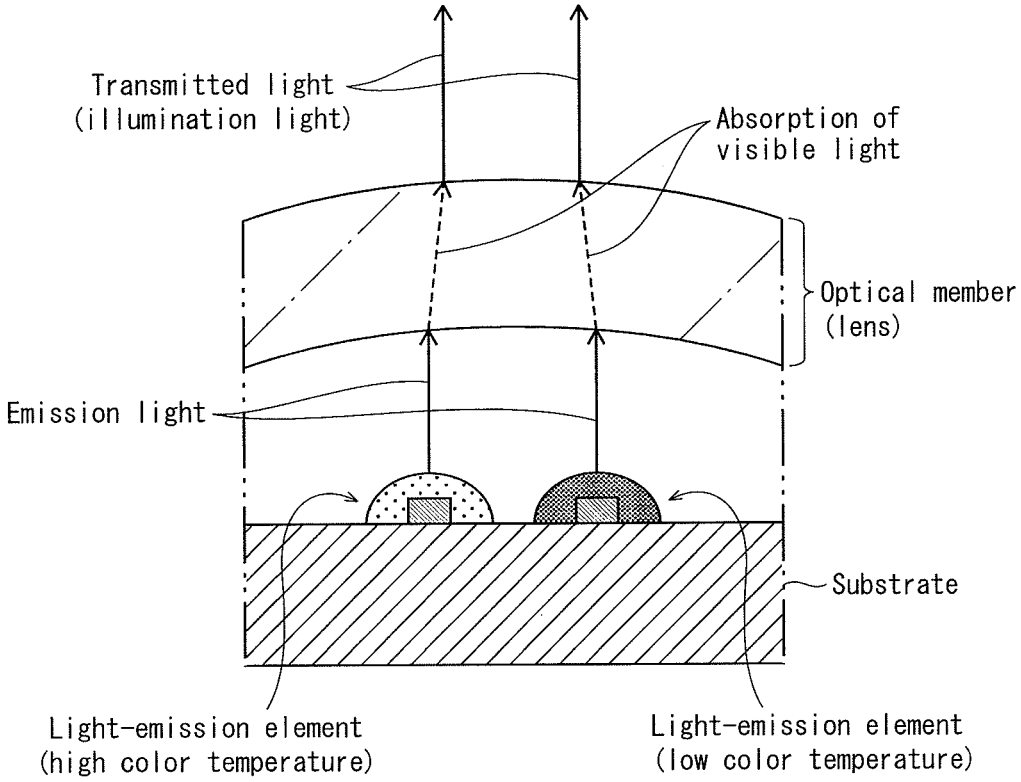

FIG. 13 is a cross-sectional view schematically illustrating a state where light emitted from a light-emission element of a high color temperature, mounted on a substrate of a light-emission module, and light emitted from a light-emission element of a low color temperature, also mounted on the substrate, are passing through an optical member (a lens).

Figure 14:
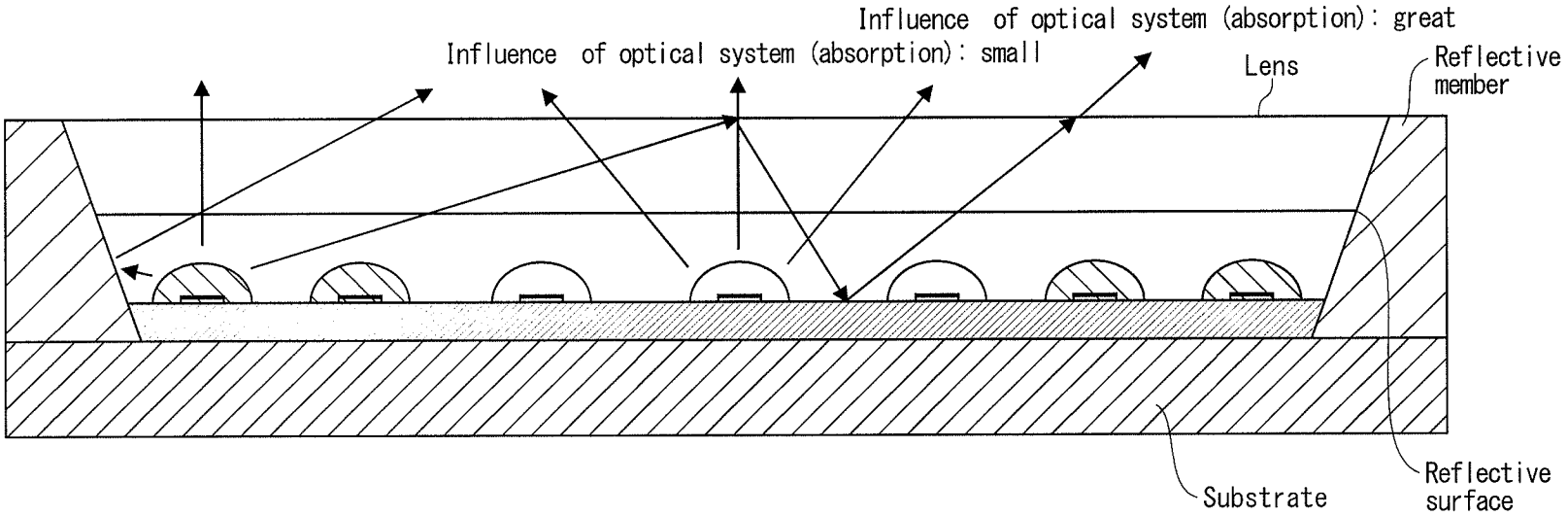

FIG. 14 is a cross-sectional view illustrating an example of a structure of a light-emission module.

DESCRIPTION OF EMBODIMENTS

In the following, description is provided on embodiments of the present invention.

<Embodiment 1>

(Overall Structure of LED Lighting Device 1)

Figure 1:
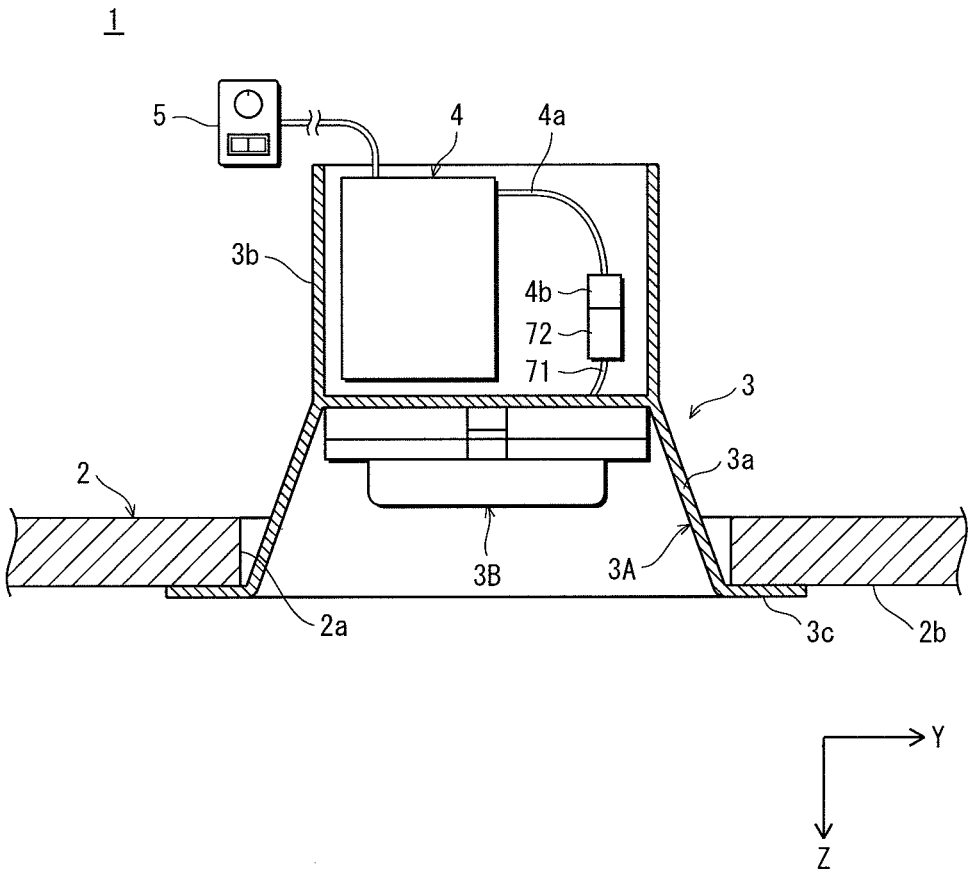
FIG. 1 is partial cross-sectional view illustrating a structure of an LED illumination device 1 pertaining to embodiment 1 of the present invention.
Figure 2:
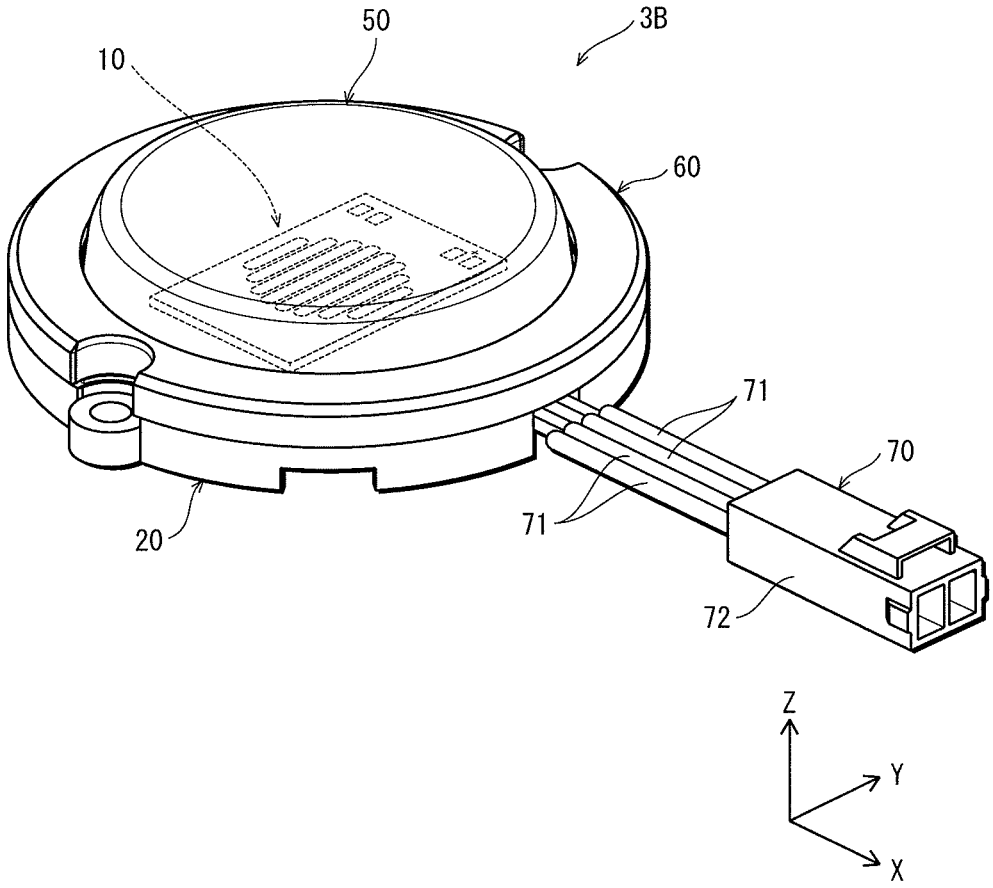
FIG. 2 is a perspective view illustrating an external structure of a lamp unit 3B.
Figure 3:
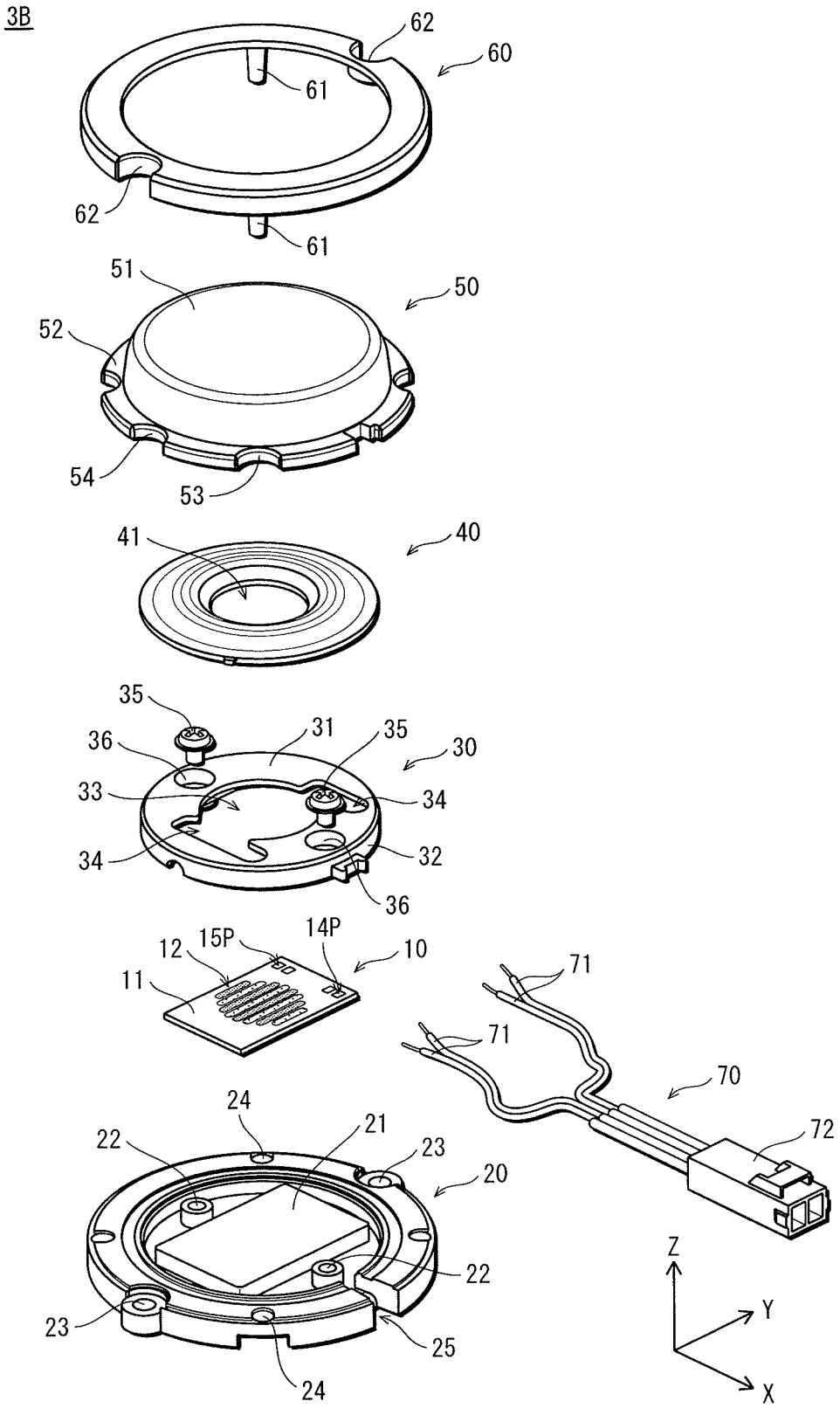
FIG. 3 is an exploded perspective view illustrating an internal structure of the lamp unit 3B.

FIG. 1 is a cross-sectional view illustrating a structure of an LED illumination device 1 pertaining to embodiment 1 of the present invention. Note that the LED illumination device 1 is simply referred to as "device 1" in the following. FIG. 2 is a perspective view illustrating an external structure of a lamp unit 3B included in the device 1. FIG. 3 is an exploded perspective view illustrating an internal structure of the lamp unit 3B. FIG. 4 illustrates a structure of a light-emission module 10 included in the device 1. FIG. 5 is a wiring diagram illustrating a connection between the light-emission module 10, a circuit unit 4, and a light adjustment unit 5, all of which are included in the device 1.

The device 1 includes a lighting apparatus 3, the circuit unit 4, and the light adjustment unit 5. As illustrated in FIG. 1, the device 1 is, for example, a downlight-type illumination device (a ceiling light) that is buried in an installation hole 2*a* formed in a ceiling 2.

(Lighting Apparatus 3)

The lighting apparatus 3 includes the lamp unit 3B and an apparatus casing 3A.

The apparatus casing 3A is made of metal, for example, and includes a lamp accommodating part 3*a*, a circuit accommodating part 3*b*, and a flange part 3*c*.

The lamp accommodating part 3*a* has a based cylindrical shape, for example, and the lamp unit 3B is detachably attached inside the lamp accommodating part 3*a*.

The circuit accommodating part 3*b* extends, for example, from a based portion of the lamp accommodating part 3*a*, as illustrated in FIG. 1, and accommodates the circuit unit 4 therein.

The flange part 3*c* has an annular ring shape, for example, and extends outwards from an opening portion of the lamp accommodating part 3*a*, as illustrated in FIG. 1.

Upon installation of the device 1, the apparatus casing 3A, i.e., the lamp accommodating part 3*a* and the circuit accommodating part 3*b*, is buried in the installation hole 2*a*, which is formed to penetrate the ceiling 2. While the flange part 3*c* is held in contact with a circumferential portion of the installation hole 2*a*, which corresponds to a portion of a lower surface 2*b* of the ceiling 2, the flange portion 3*c* is attached to the ceiling 2 by using one or more attachment screws (undepicted in FIG. 1).

(Circuit Unit 4)

The circuit unit 4 causes the lamp unit 3B to light when the device 1 is driven.

The circuit unit 4 includes a power line 4*a*, a connector 4*b*, a lighting circuit portion 4*c*, a light adjustment ratio detection circuit portion 4*d*, and a control circuit portion 4*e* (as illustrated in FIGS. 1 and 5). The circuit unit 4 is electrically connected to an external commercial AC power source (undepicted). The circuit unit 4 supplies current input thereto from the commercial AC power source to the light-emission module 10.

Note that although the lamp unit 3B and the circuit unit 4 are provided as separate units in the device 1, in the illumination device pertaining to the present invention, the circuit unit may be built into the lamp unit.

(i) Control Circuit Portion 4*e*

The control circuit portion 4*e* includes a microcomputer and a memory. The memory stores a control program that the microcomputer uses to drive the components of the device 1. When the device 1 is driven, the microcomputer of the control circuit portion 4*e* separately controls, via the lighting circuit portion 4*c*, light-emission of light-emission elements 13 included in a first light-emission part 12*a* and light-emission of light-emission elements 13 included in a second light-emission part 12*b*. The microcomputer performs the control of the light-emission of the light-emission elements 13 based on the control program stored in the memory and according to light adjustment ratios indicated by a light adjustment signal input from the light adjustment ratio detection circuit portion 4*d*. Note that in the present disclosure, the light adjustment ratio for a given one of the first light-emission part 12*a* and the second light-emission part 12*b* indicates a ratio of actual luminous flux of the given one of the first light-emission part 12*a* and the second light-emission part 12*b* to a total luminous flux thereof, which corresponds to when all (100%) of the light-emission elements 13 therein are lighted.

More specifically, the microcomputer of the control circuit portion 4*e* sets, based on predetermined light adjustment ratios, duty ratios of currents applied to the light-emission elements 13 in a light-emission unit 12 (refers to a combination of the first light-emission part 12*a* and the second light-emission part 12*b*). Based on the PWM control described above, the microcomputer separately controls light-emission of the light-emission elements 13 included in the first light-emission part 12*a* and light-emission of the light-emission elements 13 included in the second light-emission part 12*b*. Further, by separately controlling light-emission of the first light-emission part 12*a* and light-emission of the second light-emission part 12*b*, the microcomputer adjusts the color temperature of light emitted from the light-emission unit 12 as a whole.

(ii) Light Adjustment Ratio Detection Circuit Portion 4*d*

The light adjustment ratio detection circuit portion 4*d* detects the light adjustment signal, which is input from the light adjustment unit 5. The light adjustment ratio detection circuit portion 4*d* outputs the light adjustment signal so detected to the control circuit portion 4*e*.

(iii) Lighting Circuit Portion 4*c*

The lighting circuit portion 4*c* includes an AC/DC converter (undepicted). The AC/DC converter is composed of a conventional diode bridge, etc. The lighting circuit portion 4*c* is electrically connected with lead wires 71 via a connector 72. Thus, the lighting circuit portion 4*c* supplies the light-emission elements 13 included in the first light-emission part 12*a* and the second light-emission part 12*b* with power.

When the device 1 is driven, the lighting circuit portion 4*c* converts an AC voltage from the commercial AC power source into a constant DC current at the AC/DC converter. Subsequently, according to an instruction from the control circuit portion 4*e*, the lighting circuit portion 4 applies the DC voltage as a positive voltage on the light-emission elements 13 of at least one of the first light-emission part 12*a* and the second light-emission part 12*b*.

(Light Adjustment Unit 5)

The light adjustment unit 5 is a unit that an user of the device 1 uses to set a color temperature of illumination light from the lamp unit 3B. The light adjustment unit 5 is electrically connected with the circuit unit 4. For example, when the device 1 is actually used, the light adjustment unit 5 is installed at a location where the user of the device 1 is able to operate the light adjustment unit 5 with ease (for example, on a room wall). Further, when the user operates the light adjustment unit 5 to control the illumination light from the lamp unit 3B, a light adjustment signal is transmitted from the light adjustment unit 5 to the light adjustment ratio detection circuit portion 4*d* of the circuit unit 4.

In addition, the light adjustment unit 5 is provided with a power switch for turning on the power of the device 1. Further, the combination of the circuit unit 4 and the light adjustment unit 5 is referred to in the present disclosure as a color adjustment unit 5A.

(Lamp Unit 3B)

The lamp unit 3B is the main part of the device 1. As illustrated in FIG. 2, the lamp unit 3B has an exterior structure where an optical member 50 included therein is exposed to the outside at an upper surface of the lamp unit 3B in the Z direction in FIG. 2. Further, the lamp unit 3B has built-in the light-emission module 10, which is illustrated by using dotted lines in FIG. 2.

The lamp unit 3B has an internal structure as illustrated in FIG. 3. More specifically, the lamp unit 3B includes the light-emission module 10, a base 20, a holder 30, a reflective member 40, the optical member 50, a frame body 60, and a wiring member 70.

(I) Base 20

The base 20 is a means for radiating heat generated by the light-emission module 10, when the device 1 is driven. The base 20 is formed by using material having excellent heat radiating properties, for example, die-cast aluminum, and is formed to have a shape of a circular plate. The base 20 has a mounting part 21 disposed at a center of an upper surface thereof. The light-emission module 10 is mounted onto the mounting part 21 such that a rear surface of the light-emission module 10 is in intimate contact with the mounting part 21.

In addition, as illustrated in FIG. 3, the upper surface of the base 20 includes screw holes 22 that threadedly engage with assembly screws 35 for fixing the holder 30 in position. The screw holes 22 are disposed at both sides of the mounting part 21, as illustrated in FIG. 3. The base 20 further includes insertion holes 23, boss holes 24, and a cutaway portion 25, which are disposed at a peripheral area of the base 20.

(II) Holder 30

The holder 30 is a means for holding the light-emission module 10 while in a state where the light-emission module 10 is pressed towards the base 20. The holder 30 includes a pressurizing plate portion 31 having a shape of a circular plate, and a peripheral wall portion 32 that has a cylindrical shape and extends from a peripheral area of the pressurizing plate portion 31 towards the base 20. By a rear surface of the pressurizing plate portion 31 being pressed towards the light-emission module 10 mounted on the mounting part 21, the light-emission module 10 is fixed to the base 20 in intimate contact with the base 20. The holder 30 is formed by using resin material, for example.

A window hole 33 is formed in a center of the pressurizing plate portion 31. The window hole 33 is for exposing the light-emission unit 12 of the light-emission module 10 through the pressurizing plate portion 31. In addition, opening portions 34 are formed at a peripheral area of the pressurizing plate portion 31. The opening portions 34 are continuous with the window hole 33, and prevent the lead wires 71 that are electrically connected with the light-emission module 10 from interfering with the holder 30. Further, insertion through holes 36 that receive insertion of the assembly screws 35 are also disposed at the peripheral area of the pressurizing plate portion 31. The insertion through holes 36 are disposed at locations corresponding to the locations of the screw holes 22 in the base 20.

The assembly screws 35 are inserted from above the pressurizing plate portion 31 of the holder 30 to pass through the insertion through holes 36. Further, by threadedly engaging the assembly screws 35 to the screw holes 22, the holder 30 is attached to the base 20.

(III) Reflective Member 40

The reflective member 40 is a means for reflecting light emitted from the light-emission unit 12 of the light-emission module 10 towards the optical member 50. More specifically, light emitted from the light-emission unit 12 is first reflected at a rear surface of the optical member 50 (the surface of the optical member 50 in the lower direction in FIG. 3), and is then reflected once again by the reflective member 40 towards the optical member 50. The reflective member 40 is made of non-transmissive material such as white, non-transparent resin material, for example. Further, the reflective member 40 is formed to have a circular annular shape so as not to interfere with the optical path of the light emitted from the light-emission unit 12. In addition, a window hole 41 is formed in a center of the reflective member 40. The window hole 41 is for exposing wavelength conversion members 14 of the light-emission module 10, etc., through the reflective member 40.

The reflective member 40 is disposed between the holder 30 and the optical member 50. The provision of the reflective member 40 prevents the lead wires 71, the assembly screws 35, etc., from being exposed and thus being visible from the outside through the opening portions 34. Due to this, the reflective member 40 is a "decoration cover", if referred to by using a commonly-used term.

(IV) Optical Member 50

The optical member 50 is formed, for example, by using highly light-transmissive material, such as silicone resin, acrylic resin, and glass. The optical member 50 includes a main body portion 51 having a dome shape and the structure of a lens, and a flange portion 52 that extends outwards from a peripheral area of the main body portion 51. The main body portion 51 is disposed on the optical path of the light emitted from the light-emission unit 12 of the light-emission module 10. Further, the optical member 50 is fixed in position by the flange portion 52 being held in a sandwiched state between the frame body 60 and the base 20.

Here, note that the optical member 50 is disposed so as to cover the reflective member 40, etc. Due to this, the optical member 50 is a "cover", if referred to by using a commonly-used term.

In addition, the flange portion 52 has formed therein cutaway portions 53 and cutaway portions 54. The cutaway portions 53 have semicircular shapes and prevent the flange portion 52 from interfering with boss portions 61 of the frame body 60. The cutaway portions 54 prevent the flange portion 52 from interfering with the attachment screws (undepicted) that are to be inserted to the insertion holes 23 of the base 20.

When the device 1 is driven, the light emitted from the light-emission unit 12 permeates through the main body portion 51 of the optical member 50, and is thus guided out to the outside of the lamp unit 3B as illumination light from the device 1.

(V) Frame Body 60

The frame body 60 is a means for fixing the optical member 50 to the base 20. Specifically, by using the frame body 60, the flange portion 52 is held in a state where the flange portion 52 presses towards the base 20. The frame body 60 is formed by using, for example, non-light-transmissive material. Examples of non-light-transmissive material usable for forming the frame body 60 include a metal such as aluminum and a white, non-transparent resin. Further, the frame body 60 is formed to have a circular annular shape so as not to interfere with the optical path of the light emitted from the light-emission unit 12 of the light-emission module 10.

As illustrated in FIG. 3, the frame body 60 includes, protruding towards the base 20 from a lower surface thereof, the boss portions 61 having cylindrical shapes. Further, cutaway portions 62 are formed at a peripheral area of the frame body 60. The cutaway portions 62 prevent the frame body 60 from interfering with the attachment screws (undepicted) that are to be inserted to the insertion holes 23 of the base 20.

In the lamp unit 3B in assembled state, tip portions of the boss portions 61 have a greater diameter compared to before the assembly of the lamp unit 3B. This is since, in the assembly of the lamp 3B, the tip portions of the boss portions 61 are melted through laser processing while being inserted into the boss holes 24, to ensure that the tip portions of the boss portions 61 do not separate from the boss holes 24. Thus, the frame body 60 is fixed to the base 20.

(IV) Wiring Member 70

The wiring member 70 includes two pairs of lead wires each including two of the lead wires 71 (i.e., includes a total of four of the lead wires 71) and the connector 72. One end of each of the lead wires 71 is electrically connected to the light-emission module 10. The other ends of the lead wires 71 are bundled together and electrically connected, in the bundled state, to a terminal portion (undepicted) inside the connector 72. The connector 72 is attachable to and detachable from the connector 4*b* (refer to FIG. 1). In the lamp unit 3B, the connector 72 of the wiring member 70 extends to the outside from the cutaway portion 25 of the base 20. The wiring member 70 electrically connects the light-emission module 10 and the circuit unit 4.

(VII) Light-Emission Module 10

Figure 4A:
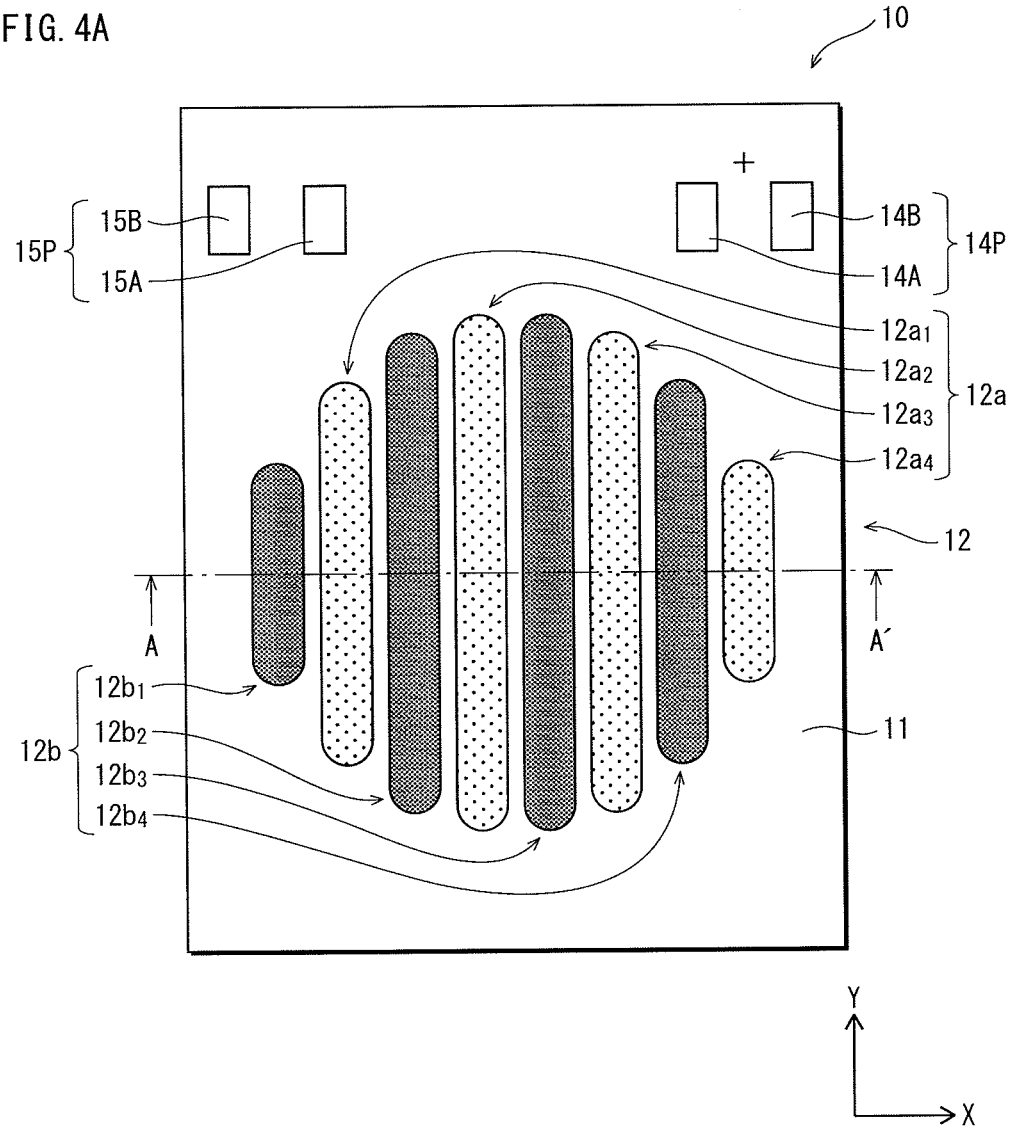
FIG. 4A is a front surface diagram illustrating a structure of a light-emission module 10.
Figure 4B:
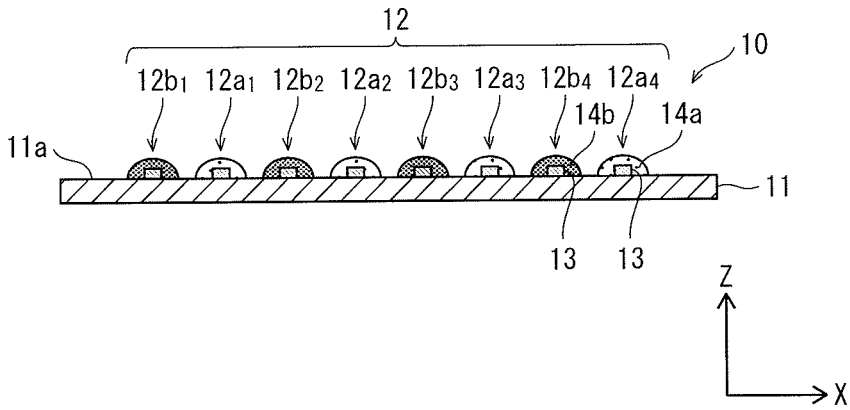
FIG. 4B is a cross-sectional view taken along line A-A' in FIG. 4A and illustrating the structure of the light-emission module 10.
Figure 5:
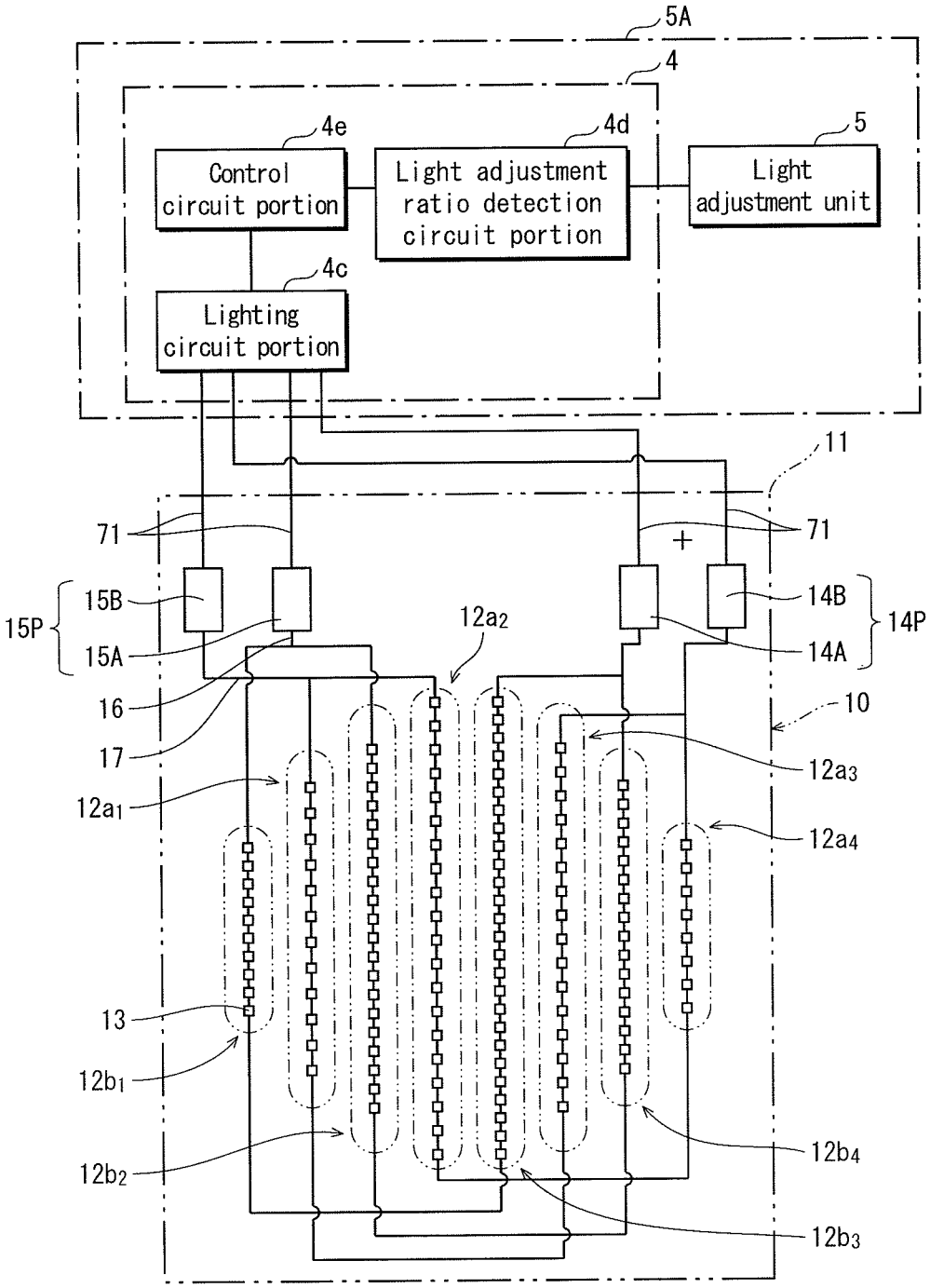
FIG. 5 is a wiring diagram illustrating a connection between the light-emission module 10, a circuit unit 4, and a light adjustment unit 5.

FIG. 4A is a front surface diagram of the light-emission module 10. Here, the front surface of the light-emission module 10 is the surface of the light-emission module 10 when viewed from above. FIG. 4B is a cross-sectional view of the light-emission module 10, taken along line A-A' in FIG. 4A.

As illustrated in FIGS. 4A, 4B, and 5, the light-emission module 10 includes a substrate 11, the light-emission unit 12, terminal groups 14P and 15P, and wirings 16 and 17 (undepicted in FIG. 4). The light-emission module 10 is an LED module since LEDs are used in the light-emission unit 12.

(i) Substrate 11

The substrate 11 has, for example, a structure composed of two layers layered one on top of the other, one layer being an insulating layer made of a ceramic substrate, heat-conduction resin, or the like, and the other layer being a metal layer made of an aluminum plate or the like. The substrate 11 has an exterior shape of a rectangular plate.

(ii) Light-Emission Unit 12

The light-emission unit 12 includes the first light-emission part 12*a* and the second light-emission part 12*b*, both of which are disposed on an upper surface 11*a* of the substrate 11.

The first light-emission part 12*a* includes a plurality of element arrays $\mathbf{12}a_1$ through $\mathbf{12}a_4$. The element arrays $\mathbf{12}a_1$ through $\mathbf{12}a_4$ are disposed parallel to one another and form a stripe pattern. Each of the element arrays $\mathbf{12}a_1$ through $\mathbf{12}a_4$ includes a plurality of the light-emission elements 13 and a first wavelength conversion member 14*a*. Further, light emitted from the first light-emission part 12*a* has a relatively high color temperature.

The second light-emission part 12*b* is similar to the first light-emission part 12*a*, and includes a plurality of element arrays $\mathbf{12}b_1$ through $\mathbf{12}b_4$. The element arrays $\mathbf{12}b_1$ through $\mathbf{12}b_4$ are disposed parallel to one another and form a stripe pattern. Each of the element arrays $\mathbf{12}b_1$ through $\mathbf{12}b_4$ includes a plurality of the light-emission elements 13 and a second wavelength conversion member 14*b*. Further, light emitted from the second light-emission part 12*b* has a relatively low color temperature.

Note that the light-emission elements 13 are not limited to being LEDs. That is, the light-emission elements 13 may be, for example, laser diodes (LDs) or electric luminescence elements (EL elements).

[Light-Emission Elements 13]

The light-emission elements 13 are, for example, GaN type LEDs that emit blue light having a main peak within a wavelength range from 430 nm to 470 nm. Further, by utilizing the chip on board (COB) technology, the light-emission elements 13 are mounted (mounted face-up) on the upper surface 11*a* of the substrate 11 with fixed intervals therebetween.

[First Wavelength Conversion Member 14*a*]

The first wavelength conversion member 14*a* is formed by dispersing fluorescent material in transparent material. Here, the transparent material may be, for example, transparent resin material. For example, the first wavelength conversion member 14*a* includes the fluorescent material in an amount of approximately 12 wt %. Further, the first wavelength conversion member 14*a* includes, as the fluorescent material, a combination of red fluorescent material, and one of green fluorescent material and yellow fluorescent material. In this example, the fluorescent material included in the first wavelength conversion member 14*a* includes red fluorescent material and green fluorescent material at a ratio of 1:19. Further, the fluorescent material may be included in the first wavelength conversion member 14*a* in the form of fluorescent material particles. In addition, as the transparent resin material in which the fluorescent material is dispersed, silicone resin, fluoride resin, silicone epoxy hybrid resin, or urea resin may be used, for example. In each of the element arrays $\mathbf{12}a_1$ through $\mathbf{12}a_4$, the first wavelength conversion member 14*a* is disposed on the optical path of the light emitted from the light-emission elements 13 included in the element array so as to collectively cover the light-emission elements 13 (refer to FIGS. 4A and 4B).

The first wavelength conversion member 14*a* converts some of the light emitted from the light-emission elements 13 included in the first light-emission part 12*a*. Due to this, the color temperature of the light emitted from the first light-emission part 12*a* is set to the daylight color temperature (a correlated color temperature of approximately 8000 K), which is the first color temperature in the present invention. Note that the first color temperature may be any color temperature higher than or equal to 6000 K.

[Second Wavelength Conversion Member 14*b*]

The second wavelength conversion member 14*b* has the same structure as the first wavelength conversion member 14*a*. Further, the second wavelength conversion member 14*b* may include, as fluorescent material, a combination of red fluorescent material, and one of green fluorescent material and yellow fluorescent material. Here, for example, the second wavelength conversion member 14*b* includes the fluorescent material in an amount of approximately 40 wt %. Further, in this example, the fluorescent material included in the second wavelength conversion member 14*b* includes red fluorescent material and green fluorescent material at a ratio of 1:9. As such, the second wavelength conversion member 14*b* differs from the first wavelength conversion member 14*a* in terms of the amount (weight proportion (wt %)) in which the fluorescent material is included, and the ratio between the red fluorescent material and green fluorescent material included therein.

Note that the types of fluorescent material included in each of the first wavelength conversion member 14*a* and the second wavelength conversion member 14*b* are not limited to those described above, and further, the amount in which the fluorescent material is included in each of the first wavelength conversion member 14*a* and the second wavelength conversion member 14*b* (weight proportion (wt %)) are not limited to those described above.

The device 1 is characterized in that, due to the second wavelength conversion member 14*b* converting some of the light emitted from the light-emission elements 13 included in the second light-emission part 12*b*, the color temperature of the light emitted from the second light-emission part 12*b* is set to the incandescent lamp color temperature (a correlated color temperature of approximately 2238 K), which is the second color temperature in the present invention. Due to this, when the second light-emission part 12*b* is caused to emit light individually, the light emitted by the second light-emission part 12*b* has the color of candle light. Note that the second color temperature may be any color temperature lower than 2600 K.

[Arrangement of First Light-Emission Part 12*a* and Second Light-Emission Part 12*b*]

As illustrated in FIG. 4A, the first light-emission part 12*a* and the second light-emission part 12*b* are disposed such that longitudinal directions of the element arrays $\mathbf{12}a_1$ through $\mathbf{12}a_4$ and the element arrays $\mathbf{12}b_1$ through $\mathbf{12}b_4$ coincide with the Y direction in FIG. 4A, and further, such that in the X direction in FIG. 4A, the element arrays $\mathbf{12}a_1$ through $\mathbf{12}a_4$ and the element arrays $\mathbf{12}b_1$ through $\mathbf{12}b_4$ are arranged in alternation. Further, the first light-emission part 12*a* and the second light-emission part 12*b* are arranged such that, when seen as a whole, the first light-emission part 12*a* and the second light-emission part 12*b* exhibit a circular shape on the substrate 11. When disposing the first light-emission part 12*a* and the second light-emission part 12*b* to exhibit, as a whole, a circular shape on the substrate 11 as described above, the lengths of the element arrays disposed on substrate 11 decrease as approaching both ends of the substrate 11 in the X direction from the center of the substrate 11. Accordingly, the number of the light-emission elements 13 included in the element arrays disposed on substrate 11 decrease as approaching both ends of the substrate 11 in the X direction from the center of the substrate 11. In view of this, the light-emission module 10 is provided with the structure illustrated in FIG. 5, where, by using the wiring 16, the element arrays $\mathbf{12}b_1$ and $\mathbf{12}b_3$ are connected in series to compose one unit, and the element arrays 12*b*, and $\mathbf{12}b_4$ are connected in series to compose another unit. Similarly, in the light-emission module 10, by using the wiring 17, the element arrays $\mathbf{12}a_1$ and $\mathbf{12}a_3$ are connected in series to compose one unit, and the element arrays 12*a*, and $\mathbf{12}a_4$ are connected in series to compose another unit. Further, the units formed by using the wiring 16 and the units formed by using the wiring 17 are connected in parallel, and power is supplied to each of the light-emission elements 13 included in the light-emission module 10 through such connection.

For example, the number of the light-emission elements 13 included in the element arrays $\mathbf{12}a_1$, $\mathbf{12}a_2$, $\mathbf{12}a_3$, and $\mathbf{12}a_4$ is 12, 20, 16, and 8, respectively. Due to this, each of the units formed by using the wiring 17 includes a total of 28 of the light-emission elements 13 connected in series.

On the other hand, the number of the light-emission elements 13 included in the element arrays $\mathbf{12}b_1$, $\mathbf{12}b_2$, $\mathbf{12}b_3$, and $\mathbf{12}b_4$ is 10, 20, 26, and 16, respectively. Due to this, each of the units formed by using the wiring 16 includes a total of 36 of the light-emission elements 13 connected in series.

In the above example, the number of the light-emission elements 13 connected in series in each of the units formed by using the wiring 16 (the unit formed by the element arrays $\mathbf{12}b_1$ and $\mathbf{12}b_3$ and the unit formed by the element arrays $\mathbf{121}b_2$ and $\mathbf{12}b_4$) is greater than the number of the light-emission elements 13 connected in series in each of the units formed by using the wiring 17 (the unit formed by the element arrays $\mathbf{12}a_1$ and $\mathbf{12}a_3$ and the unit formed by the element arrays $\mathbf{12}a_2$ and $\mathbf{12}a_4$). This is since, conversion efficiency of fluorescent material of a low color temperature is typically lower than conversion efficiency of fluorescent material of a high color temperature, and therefore, a great number of the light-emission elements 13 need to be included in element arrays including fluorescent material of a low color temperature to ensure that the same amount of light is emitted by the element arrays corresponding to both the high and low color temperatures.

(iii) Terminal Groups 14P, 15P and Wiring 16, 17

The terminal groups 14P, 15P and the wirings 16, 17 illustrated in FIG. 5 are conduction patterns formed on the substrate 11. The terminal group 14P includes terminal parts 14A and 14B. The terminal group 15P includes terminal parts 15A and 15B.

Each of the terminal parts 14A and 15A has electrically connected thereto one of the lead wires 71 and the wiring 16. Each of the terminal parts 14B and 15B has electrically connected thereto one of the lead wires 71 and the wiring 17.

The light-emission elements 13 included in the first light-emission part 12*a* are connected to the wiring 17. Similarly, the light-emission elements 13 included in the second light-emission part 12*b* are connected to the wiring 16.

(Operation of Device 1 when Driven)

When using the device 1, the user operates the power switch provided to the light adjustment unit 5 to turn on the power of the device 1. When the power of the device 1 has been turned on, the microcomputer of the control circuit portion 4*e* supplies power to the light-emission module 10 via the lighting circuit portion 4*c*. Here, the microcomputer performs the supply of power according to the control program stored in the memory and the light adjustment signal indicating the contents of the adjustment of the color temperature of the illumination light from the device 1 that the user has performed via the light adjustment unit 5. Accordingly, at least one of the first light-emission part 12*a* and the second light-emission part 12*b* in the light-emission unit 12 illuminates. The light emitted from the light-emission unit 12 passes through the main body portion 51 of the optical member 50, and is emitted to the outside of the device 1 as illumination light.

Here, when causing both the first light-emission part 12*a* and the second light-emission part 12*b* to illuminate, the microcomputer of the control circuit portion 4*e* performs PWM control separately for each of the first light-emission part 12*a* and the second light-emission part 12*b*, and thus separately controls light emission of the light-emission elements 13 included in the first light-emission part 12*a* and light-emission of the light-emission elements 13 included in the second light-emission part 12*b*. By performing control in such a manner, the microcomputer changes the balance between light emission by the light-emission elements 13 included in the first light-emission part 12*a* and light emission by the light-emission elements 13 included in the second light-emission part 12*b*. As such, the microcomputer adjusts the color temperature of the light emitted from the light-emission unit 12 as a whole. Note that the color temperature of the illumination light from the device 1 can be adjusted continuously within a wide range of color temperatures from at least 2238 K to at most 5000 K.

On the other hand, when causing only the first light-emission part 12*a* to illuminate, the color temperature of the illumination light from the device 1 is adjusted to the color temperature of the first light-emission part 12*a*, which is the daylight color temperature of 8000 K. Similarly, when causing only the second light-emission part 12*b* to illuminate, the color temperature of the illumination light from the device 1 is adjusted to the color temperature of the second light-emission part 12*b*, which is the incandescent lamp color temperature of 2238 K corresponding to the color of candle light.

(Effects Achieved by Device 1)

The device 1 when driven achieves the two major advantageous effects described in the following.

[1] Improvement in Color Temperature

In the device 1, the absorption, by the optical member, of predetermined spectral components of the light emitted from the light-emission part of the low color temperature, when the light emitted from the light-emission part passes through the optical member, is suppressed. Accordingly, the color temperature of the illumination light from the device 1 can be excellently adjusted to the desired color temperature. In the following, description is provided on this advantageous effect, with reference to spectra in FIG. 7 measured for the device 1 in embodiment 1 (hereinafter referred to as an "implementation example device") and spectra in FIG. 6 measured for a device for comparison (comparative example device).

Portion (a) of FIG. 6 illustrates a spectrum of light emitted from a first light-emission part (corresponding to a color temperature of 7790 K) in a conventional LED illumination device (the comparative example device), not having passed through an optical member of the comparative example device, and portion (b) of FIG. 6 illustrates a spectrum of light emitted from a second light-emission part (corresponding to a color temperature of 2750 K) in the comparative example device, not having passed through the optical member. Further, portion (c) of FIG. 6 illustrates a spectrum of the light emitted from the first light-emission part, having passed through the optical member, and portion (d) of FIG. 6 illustrates a spectrum of the light emitted from the second light-emission part, having passed through the optical member. Finally, portion (e) of FIG. 6 illustrates a spectrum of illumination light from the comparative example device having a color temperature thereof adjusted to approximately 3000 K (in specific, 2984 K) by mixing the light emitted from the first and second light-emission parts, having passed through the optical member.

On the other hand, portion (a) of FIG. 7 illustrates a spectrum of light emitted from the first light-emission part 12*a* (corresponding to a color temperature of 7790 K) in the device 1 pertaining to embodiment 1 (the implementation example device), not having passed through the optical member 50, and portion (b) of FIG. 7 illustrates a spectrum of light emitted from the second light-emission part 12*b* (corresponding to a color temperature of 2750 K) in the device 1, not having passed through the optical member 50. Further, portion (c) of FIG. 7 illustrates a spectrum of the light emitted from the first light-emission part 12*a*, having passed through the optical member 50, and portion (d) of FIG. 7 illustrates a spectrum of the light emitted from the second light-emission part 12*b*, having passed through the optical member 50. Finally, portion (e) of FIG. 7 illustrates a spectrum of the illumination light from the device 1 having a color temperature thereof adjusted to approximately 3000 K (in specific, 2984 K) by mixing the light emitted from the light-emission parts 12*a* and 12*b*, having passed through the optical member 50.

Here, note that in the measurement of the spectra illustrated in FIGS. 6 and 7, to make the advantageous effects of the present invention clearly observable, a configuration was made in each of the implementation example device and the comparative example device such that, in the optical member, the optical path of the light emitted from the second light-emission part is longer than the optical path of the light emitted from the first light-emission part. That is, by making such a configuration, the optical member in each of the implementation example device and the comparative example device was configured to absorb the light emitted from the second light-emission part by an increased amount if absorbing the light emitted from the second light-emission part. Further, a configuration was also made of adjusting the color temperature of the illumination light from both the implementation example device and the comparative example device to a color temperature of approximately 3000 K. This configuration was made on the assumption that when the color temperature of the illumination light is set to approximately 3000 K as described above, spectral changes in the wavelength range corresponding to blue light would be relatively easily observable. Table 1 shows chromaticity values and shift amounts ("Spectral Shift Amount") of the chromaticity values for the spectra of the illumination light of each of the implementation example device and the comparative example device, which correspond to combinations of the spectrums of the light emitted from the first and second light-emission parts.

TABLE 1

Measurement Results when Adjusting Color Temperature to Approximately 3000 K

| Sample | Chromaticity | Only LED Module | LED module and Lens | Spectral Shift Amount |
|---|---|---|---|---|
| Implementation | x | 0.439 | 0.439 | 0.000 |
| Example Device | y | 0.403 | 0.403 | 0.000 |
| Comparative | x | 0.435 | 0.437 | 0.003 |
| Example Device | y | 0.400 | 0.403 | 0.003 |

In the comparative example device, as illustrated in portions (a), (b), (c), and (d) of FIG. 6, changes were observed in the color temperature of the light emitted from each of the first light-emission part and the second light-emission part, when and when not having passed through the optical member. Due to this, as illustrated in portion (e) of FIG. 6 and Table 1, the spectrum of the illumination light from the comparative example device when having passed through the optical member (illustrated by using dotted lines), which is obtained by combining the light emitted from the first and second light-emission having passed through the optical member, differs from the spectrum of the illumination light from the comparative example device when not having passed through the optical member (illustrated by using solid lines), which is obtained by combining the light emitted from the first and second light-emission not having passed through the optical member. This indicates that the color temperature of the illumination light has changed between when having passed through the optical member and when not having passed through the optical member.

One cause of the above-described change in color temperature of the illumination light from the comparative example device when and when not having passed through the optical member is the presence, in a spectrum of light having a color temperature of 2750 K, of a peak within a wavelength region from 400 nm to 500 nm. When taking the spectrum of light emitted from the second light-emission part illustrated in portion (b) of FIG. 6 for example, the maximum intensity of the spectral peak present within the wavelength range from 400 nm to 500 nm (at approximately 450 nm) is about one-third of the maximum intensity within a wavelength range from 300 nm to 800 nm.

Such a peak having a certain level of intensity, which is present in the spectrum of the light emitted from the second light-emission part in the comparative example device, is absorbed by the optical member upon transmission through the optical member. Due to this, a change takes place in the shape of the spectrum of the light, and thus, the color temperature of the light from the second light-emission part in the comparative example device differs between when and when not having passed through the optical member. In addition, when yellowness in color of the optical member increases due to degradation over time, this difference in color temperature when and when not passing through the optical member is further promoted and becomes even more prominent, since such an increase in yellowness leads to the optical member absorbing an increased amount of spectral components within the wavelength region corresponding to blue light.

Further, light emitted from a light-emission part may also be absorbed by a reflective member (refer to the reflective member 40 in FIG. 3). Specifically, when light emitted from a light-emission part is reflected at a reflective member after having been reflected towards the reflective member at a rear surface of an optical member, the reflective member may absorb spectral components within the wavelength region corresponding to blue light. When spectral components within the wavelength region corresponding to blue light of light emitted by a light-emission part is absorbed by a reflective member as described above, the spectrum of the light emitted from the light-emission part may differ before and after the reflection by the reflective member.

In contrast, in the implementation example device (the device 1), the color temperature of the light emitted from the second light-emission part 12*b* is set to 2238 K. As illustrated in portion (b) of FIG. 7, in a spectrum of light having a color temperature of 2238 K, the maximum intensity within the wavelength range from 400 nm to 500 nm is no greater than one-tenth of the maximum intensity within the wavelength range of 300 nm to 800 nm. In other words, there is substantially no peak present in a spectrum of light having a color temperature of 2238 K (i.e., the light emitted from the second light-emission part 12*b* in the device 1) within the wavelength range from 400 nm to 500 nm. By providing the light emitted from the second light-emission part 12*b* with such a spectrum, the amount of the light emitted from the second light-emission part 12*b* absorbed by the optical member 50, the reflective member 40, etc., is suppressed to a low level, even if the optical member 50, the reflective member 40, etc., have the characteristics of absorbing spectral components of visible light within the short wavelength range (i.e., the wavelength range corresponding to blue light).

That is, according to the present invention, the maximum intensity within the wavelength range from 400 nm to 500 nm is set to a sufficiently low level as described above and as in the spectrum illustrated in portion (b) of FIG. 7. Due to this, even when visible light emitted from the second light-emission part 12*b* transmits through the optical member 50, substantially no change occurs in the spectrum of the light emitted from the second light-emission part 12*b* compared to when not having transmitted through the optical member 50. As such, as shown in FIG. 1, the spectral shift amount between the color temperature of the illumination light from the implementation example device, when and when not having transmitted through the optical member 50, was zero. This means that it is unlikely that the color temperature of the light emitted from the second light-emission part 12*b* changes when transmitting through the optical member 50. As such, it is concluded that the device 1 suppresses the absorption, by the reflective member 40, the optical member 50, etc., of spectrum components of light having a color temperature of approximately 2238 K (i.e., the light emitted from the second light-emission part 12*b*) within the wavelength range corresponding to blue light, and thus prevents the color temperature of the light from changing when and when not having passed through the reflective member 40, the optical member 50, etc. Due to this, when the color temperature of the illumination light from the device 1 is adjusted to approximately 2238 K, for example, the adjustment of color temperature is performed in an excellent manner such that the illumination light has a color close to that of candle light.

Generally, the longer an optical path of light in an optical member is, the greater the amount of the light absorbed by the optical member. Taking this into account, the present inventors gave consideration to a structure as illustrated in FIG. 14. FIG. 14 is a cross-sectional view illustrating a structure of a light-emission module that includes a substrate, a reflection member disposed on the substrate so as to surround light-emission parts, a light-emission part of a low color temperature disposed near the reflective member, a light-emission part of a high color temperature disposed far from the reflective member, and an optical member (a lens) disposed above the light-emission parts. In this structure, when the light-emission module is driven, much light emitted from the light-emission part of low color temperature is reflected at a reflective surface of the reflective member and enters the optical member from an oblique angle. As such, much light emitted from the low color temperature light-emission unit travels along a relatively long optical path in the optical member. Due to this, in this structure, the actual spectrum of light obtained by mixing the light emitted from both light-emission parts may differ by a great extent from the desired spectrum thereof, due to a great amount of the light emitted from the light-emission part of the low color temperature being absorbed by the optical member.

However, the illumination device pertaining to the present invention, even when the light-emission module is provided with the above-described structure, where light emitted from a light-emission part of a low color temperature travels through a relatively long optical path in an optical member, the spectrum of the light emitted from the light-emission part of the low color temperature (i.e., the second light-emission part 12*b*) does not change substantially when and when not having passed through the optical member, as already described above. Due to this, the color of the illumination light from the illumination device pertaining to the present invention is excellently adjusted to the desired light color even when the light-emission module is provided with the above structure.

Note that in the device 1, no specific control is performed of the color temperature (the daylight color temperature) of the light emitted from the first light-emission part 12*a*, which corresponds to the spectrum illustrated in portion (a) of FIG. 7. This is since the spectral components within the wavelength range corresponding to blue light is indispensable to realize color temperatures between approximately 5000 K and 8000 K. Due to this, when the light emitted from the first light-emission part 12*a* passes through the optical member 50, spectral components of the light within the wavelength range corresponding to blue light are slightly absorbed by the optical member 50. As such, the color temperature of the light emitted from the first light-emission part 12*a*, when taken individually, changes slightly when and when not having passed through the optical member 50. However, the present invention prevents the color temperature of the light emitted from the second light-emission part 12*b* from differing from the desired incandescent lamp color temperature, and thus suppresses, to as low a level as possible, the difference between the actual color temperature of the light emitted from the first light-emission part 12*a* and the second light-emission part 12*b*, when seen as a whole, and the desired color temperature. Due to this, as illustrated in portion (e) in FIG. 7, the difference between the spectrum of the illumination light actually emitted from the device 1 (illustrated by dotted lines) and the spectrum of the illumination light when not passing through the optical member 50 (illustrated by solid lines) is suppressed to a low level.

In addition, the present inventors have found, through consideration, that in the spectrum of the light emitted from the second light-emission part 12*b*, when the maximum intensity within the wavelength range from 400 nm to 500 nm is no greater than one-tenth of the maximum intensity within the wavelength range from 300 nm to 800 nm, the amount of the light emitted from the second light-emission part 12*b* that is absorbed by the optical member 50 is practically ignorable. On the other hand, when the maximum intensity within the wavelength range from 400 nm to 500 nm exceeds one-tenth of the maximum intensity within the wavelength range from 300 nm to 800 nm, a considerable difference is observed between the color temperature of the illumination light actually emitted from the illumination device and the desired color temperature, even when performing adjustment of the color temperature via the light adjustment unit. In addition, since the amount of light absorbed by the optical member 50 increases in such a case, a prominent decrease in light-emission efficiency of the illumination device is also brought about. As such, in order for the present invention to achieve the advantageous effects intended thereby, care is to be taken that, in the spectrum of the light emitted from the second light-emission part 12*b*, the maximum intensity within the wavelength range from 400 nm to 500 nm is no greater than one-tenth of the maximum intensity within the wavelength range from 300 nm to 800 nm.

Next, FIG. 8 is a chromaticity diagram illustrating a range of correlation color temperatures to which a color temperature of illumination light from a typical LED illumination device can be adjusted (illustrated by the straight line in FIG. 8). In addition, in FIG. 8, the values of correlation color temperatures to which the color temperatures of the illumination light from the implementation example device and the illumination light from the comparative example can be adjusted are plotted. The implementation example device has the same structure as the device 1. The implementation example device and the comparative example device differ only in that the color temperature of the second light-emission part is set to 2238 K in the implementation example device, whereas the color temperature of the second light-emission part is set to 2750 K in the comparative example device. The straight line in FIG. 8 is a least squares fitting line of the color temperatures 2700 K and 5000 K. In addition, the rhombus areas illustrated in FIG. 8 indicate ranges of chromaticity values typically defined by specifications for chromaticity of products, and in the rhombus areas, color temperatures closer to the black body curve are superior to color temperatures away from the black body curve.

As illustrated in FIG. 8, the implementation example device and the comparative example device realize the adjustment of color temperature at a similar level when the desired color temperature is within a range between approximately 3000 K and 4000 K. However, the difference between the actual color temperature of the illumination light from the comparative example device and the corresponding color temperature on the black body curve increases, particularly when adjusting the color temperature of the illumination light from the comparative example device to a low color temperature around the incandescent lamp color temperature. As such, a prominent difference is observed between the actual color temperature of the illumination light from the comparative example device and the desired color temperature when adjusting the color temperature of the comparative example device to a low color temperature, which is not observed in the case of the implementation example device. This difference is considered as being a result of spectral components, within the wavelength range corresponding to blue light, of the light emitted from the light-emission part of the low color temperature being absorbed upon passing through the optical member, and thus, the actual color temperature of the light emitted from the light-emission part of the low color temperature having diverged from the desired color temperature value.

In contrast, when turning to the implementation example device, the difference between the actual color temperature of the illumination light from the implementation example device and the corresponding color temperature on the black body curve is relatively small even when adjusting the color temperature of the illumination light to a low color temperature around the incandescent lamp color temperature. As such, the difference between the actual color temperature of the illumination light from the implementation example device and the desired color temperature is suppressed. This is considered as being a result of the color temperature of the second light-emission part being set to 2238 K, and thus, the spectral intensity within the wavelength range corresponding to blue light being reduced, which further results in the absorption, by the optical member 50, of spectral components, within the wavelength range corresponding to blue light, of the light emitted from the light-emission part of the low color temperature being suppressed. As such, the value of the actual color temperature of the illumination light is kept within a close range from the desired color temperature value.

[2] Effect of Improving Light-Emission Efficiency

FIG. 9 is a graph illustrating transmittance (spectral characteristics) of a typical lens member with respect to wavelengths of a visible spectrum. The lens member in FIG. 9 has characteristics of absorbing a maximum of approximately 25% of spectral components within a wavelength range corresponding to blue light from approximately 370 nm to 550 nm. Here, note that the amount of spectral components of visible light that a lens member absorbs increases for shorter wavelengths.

As such, when light emitted from a light-emission part has a spectral peak at a wavelength range corresponding to blue light, spectral components of the emitted light corresponding to the peak are absorbed by the lens member illustrated in FIG. 9 upon passing through the lens member. When light emitted from a light-emission part is absorbed by the lens member in such a manner, the proportion of light usable as illumination light to the total amount of light emitted by the light-emission part decreases, and thus, light-emission efficiency of the illumination device may decrease.

In view of such a problem, in the device 1, the color temperature of the second light-emission part 12*b* is set to a color temperature of 2238 K. In the spectrum of light having a color temperature of 2238 K, the intensity within the wavelength range from 400 nm to 500 nm is relatively small. Due to this, the amount of spectral components, within the wavelength range from 400 nm to 500 nm, of the light emitted from the light-emission part 12*a* that is absorbed by the optical member 50 is suppressed to as small an amount as possible. As a result, the light emitted from the second light-emission part 12*b*, having the color temperature of 2250 K, is effectively useable in the illumination light, and thus, the light-emission efficiency of the device 1 is prevented from decreasing.

FIG. 10 is a graph illustrating a relation between a color temperature and light-emission efficiency of a light-emission part. In the measurement, the light-emission part was provided with different color temperatures by controlling the amount of fluorescent material included in the wavelength conversion member therein and the types of fluorescent material included in the wavelength conversion member. As illustrated in FIG. 10, the light-emission part exhibited relatively good light-emission efficiency for color temperatures around 5000 K. However, the light-emission efficiency of the light-emission part was lower for lower color temperatures. In particular, the light-emission part exhibited considerably low light-emission efficiency for color temperatures near 2500 K corresponding to candle light. Here, a light-emission part of a low color temperature includes a larger amount of red fluorescent material in the wavelength conversion material than a light-emission part of a high color temperature. This relatively large amount of red fluorescent material included in light-emission parts for lower color temperatures is considered as being one reason why light-emission parts for lower color temperatures have relatively low light-emission efficiency. Generally, the excitation rate at which red fluorescent material is excited by light emitted from light-emission elements remains yet to be improved. Due to this, when a large amount of red fluorescent material is used in a light-emission part, the light-emission efficiency of the light-emission part may decrease in proportion.

Concerning such a problem, the present invention does not relate to improving the excitation rate of fluorescent material included in light-emission parts. Instead, the present invention suppresses the decrease in light-emission efficiency of the illumination device when the color temperature of illumination light from the illumination device is adjusted to a low color temperature, by suppressing the absorption, by the optical member, of spectral components of light emitted from the light-emission parts in the illumination device.

<Embodiment 2>

In the following, description is provided on another embodiment of the present invention differing from that described in embodiment 1, while mainly focusing on the differences from embodiment 1. FIG. 11 is an exploded perspective view illustrating an internal structure of a lamp unit 3C in a lighting apparatus pertaining to embodiment 2. FIG. 12 is a wiring diagram illustrating a connection between a light-emission module 10A, a light-emission module 10B, the circuit unit 4, and the light adjustment unit 5.

As illustrated in FIG. 11, the lamp unit 3C differs from the lamp unit 3B in that the first light-emission part 12*a* and the second light-emission part 12*b*, having different color temperatures, are separately mounted on a light-emission module 10A and a light-emission module 10B, respectively.

As illustrated in FIG. 12, the light-emission module 10A has disposed therein the terminal parts 14A and 14B and wirings 16A and 17A. By using the wirings 16A and 17A, the element arrays $12a_1$ through $12a_4$ of the first light-emission part 12*a* are connected so as to form two units each having the same number of the light-emission elements 13 connected in series. Specifically, the number of the light-emission elements 13 connected in series in each of the units in the light-emission module 10A formed by using the wirings 16A and 17A is 28.

On the other hand, the light-emission module 10B has disposed therein the terminal parts 14B and 15B and the wirings 16B and 17B. By using the wirings 16B and 17B, the element arrays $12b_1$ through $12b_4$ of the second light-emission part 12*b* are connected so as to form two units each having the same number of the light-emission elements 13 connected in series. Specifically, the number of the light-emission elements 13 connected in series in each of the units in the light-emission module 10B formed by using the wirings 16B and 17B is 36.

In each of the light-emission module 10A and the light-emission module 10B, the two units as described above are connected in parallel. Further, the light-emission module 10A and 10B are held together as one on the mounting part 21 by the holder 30.

The lighting apparatus pertaining to embodiment 2, which has the structure as described above, achieves the same effects as the lighting apparatus in embodiment 1. Further, the lighting apparatus pertaining to embodiment 2 is configured to include the light-emission modules 10A and 10B. The light-emission modules 10A and 10B are disposed as separate components, and each have the corresponding one of the light-emission parts 12*a* and 12*b* mounted thereon. Due to this, two light-emission modules can be selected and combined in the lighting apparatus pertaining to embodiment 2, according to the desired color temperature of the illumination light of the lighting apparatus. As such, the lighting apparatus pertaining to embodiment 2 is expected to achieve the effect of improving the flexibility in designing the illumination device.

<Other Matters>

In the embodiments, the color temperature of the second light-emission part is set to 2238 K. However, the present invention is not limited to this. That is, as long as the light emitted from the second light-emission part is such that, in a spectrum thereof, the maximum intensity within the wavelength range from 400 nm to 500 nm is no greater than one-tenth of the maximum intensity within the wavelength range from 300 nm to 800 nm, the color temperature of the second light-emission part may be set to color temperatures other than 2238 K.

Note that, the color temperature value of the second light-emission part is set to different values in the comparative example device corresponding to FIG. 6 (2750 K) and in the implementation example device corresponding to FIG. 7 (2238 K). However, if (i) the color temperature of the illumination light from the implementation example device and the color temperature of the illumination light from the comparative example device were to be adjusted to the same color temperature, and (ii) the mixture of light emitted from the first and second light-emission parts were not caused to pass through the optical member in each of the two devices, the spectrum of the illumination light from the two devices would be identical to each other.

Further, in the examples illustrated in FIGS. 6 and 7, the color temperature of the illumination light of each of the devices was adjusted to approximately 3000 K. The advantageous effect of the present invention of suppressing the difference between the actual color temperature of the illumination light and the desired color temperature is realized to a greater extent when the color temperature of the illumination light is adjusted to a color temperature closer to that of the second light-emission part. However, even if the color temperature of the illumination light is adjusted to a color temperature higher than approximately 3000 K (for example, 5000 K), the present invention is expected to realize the above-described advantageous effect of suppressing the difference between the actual color temperature of the illumination light and the desired color temperature at least to some extent.

In the embodiments, the color temperature of the second light-emission part is set to 2238 K, which is lower than a color temperature of a conventional light-emission part of a low color temperature (for example, 2750 K). When setting the color temperature of the second light-emission part to 2238 K, a greater amount of fluorescent material is included in the wavelength conversion member of the second light-emission part compared to in a wavelength conversion member of a conventional light-emission part of a low color temperature. Due to this, it can be assumed that conversion loss when fluorescent material converts light emitted from light-emission elements into visible light is slightly greater in the present invention compared to in conventional technology. However, this conversion loss, typically, is extremely small. As such, a slight increase in this conversion loss does not influence, by much, the advantageous effects achieved by the present invention.

Further, the optical member 50 described in the embodiments is not limited to the structure including the main body portion 51 (lens). That is, the optical member 50 may be a simple transparent filter.

In addition, in the embodiments, description is provided that the wavelength conversion members 14*a* and 14*b* each include a combination of green fluorescent material and red fluorescent material. However, the present invention is not limited to this, and fluorescent material of other colors may be used in the wavelength conversion members 14*a* and 14*b*. Further, the color of light emitted by the light-emission elements 13 is not limited to blue, and the light-emission elements 13 may emit light having colors other than blue.

REFERENCE SIGNS LIST

1 LED lighting device
2 ceiling
3A lighting apparatus
4 circuit unit
5 light adjustment unit
5A color adjustment unit
3B, 3C lamp units
10, 10A, 10B light-emission modules (LED modules)
11, 11A, 11B substrate
12 light-emission unit
12*a* first light-emission part
12*b* second light-emission part
$\mathbf{12}a_1$-$\mathbf{12}a_4$, $\mathbf{12}b_1$-$\mathbf{12}b_4$ element arrays
13 light-emission element
14P, 15P terminal groups
16, 16A, 16B, 17, 17A, 17B wirings
14*a* first wavelength conversion member
14*b* second wavelength conversion member
20 base
21 mounting portion
30 holder
40 reflective member
50 optical member
51 main body portion
60 frame body
70 wiring member

The invention claimed is:

1. An illumination device comprising:

a first light-emission part that emits light of a first correlated color temperature;

a second light-emission part that emits light of a second correlated color temperature, the second correlated color temperature being lower than the first correlated color temperature;

an optical member that is disposed at least on an optical path of the light emitted from the second light-emission part; and a color adjustment unit that adjusts a color of light that is a mixture of the light emitted from the first light-emission part and the light emitted from the second light-emission part by controlling an intensity of the light emitted from the first light-emission part and an intensity of the light emitted from the second light-emission part, wherein in a spectrum of the light emitted from the second light-emission part, a maximum intensity within a wavelength range from 400 nm to 500 nm is no greater than one-tenth of a maximum intensity within a wavelength range from 300 nm to 800 nm.

2. The illumination device of claim 1, wherein the second correlated color temperature is lower than 2600 Kelvin (K).

3. The illumination device of claim 1, wherein at least one of the first light-emission part and the second light-emission part includes one or more light-emission elements and a wavelength conversion member that converts a wavelength of light emitted from the one or more light-emission elements, wherein a spectrum of the light emitted from the one or more light-emission elements has a main peak within a wavelength range from 430 nm to 470 nm, and the wavelength conversion member is made of transparent material and fluorescent material dispersed in the transparent material, the fluorescent material being a combination of red fluorescent material, and one of green fluorescent material and yellow fluorescent material.

4. The illumination device of claim 1, wherein the optical member includes an optical element that absorbs light within the wavelength range from 400 nm to 500 nm.

5. The illumination device of claim 1, wherein the first correlated color temperature is higher than or equal to 6000 Kelvin (K).

6. The illumination device of claim 1 further comprising:

a mounting substrate on which the first light-emission part and the second light-emission part are mounted.

7. The illumination device of claim 1 further comprising:

a first mounting substrate on which the first light-emission part is mounted; and a second mounting substrate on which the second light-emission part is mounted.

8. A light-emission module comprising:

a substrate; and a light-emission unit disposed on the substrate, the light-emission unit including:

a first light-emission part that emits light of a first correlated color temperature; and a second light-emission part that emits light of a second correlated color temperature, the second correlated color temperature being lower than the first correlated color temperature, wherein in a spectrum of the light emitted from the second light-emission part, a maximum intensity within a wavelength range from 400 nm to 500 nm is no greater than one-tenth of a maximum intensity within a wavelength range from 300 nm to 800 nm.

9. The light-emission module of claim 8, wherein at least one of the first light-emission part and the second light-emission part includes one or more light-emission elements and a wavelength conversion member that converts a wavelength of light emitted from the one or more light-emission elements, wherein a spectrum of the light emitted from the one or more light-emission elements has a main peak within a wavelength range from 430 nm to 470 nm, the wavelength conversion member is made of transparent material and fluorescent material dispersed in the transparent material, the fluorescent material being a combination of red fluorescent material, and one of green fluorescent material and yellow fluorescent material, and the wavelength conversion member is disposed so as to cover the one or more light-emission units.

10. The light-emission module of claim 8, wherein the second correlated color temperature is lower than 2600 Kelvin (K).

11. The light-emission module of claim 8, wherein at least one of the first light-emission part and the second light-emission part includes one or more light-emission elements and a wavelength conversion member that converts a wavelength of light emitted from the one or more light-emission elements, wherein the wavelength conversion member is made of transparent resin and fluorescent material dispersed in the transparent resin.

12. The light-emission module of claim 9, wherein the wavelength conversion member is made of transparent resin and fluorescent material dispersed in the transparent resin.

* * * * *